US007909748B2

(12) United States Patent
Calvagne et al.

(10) Patent No.: US 7,909,748 B2
(45) Date of Patent: Mar. 22, 2011

(54) EXERCISE APPARATUS

(75) Inventors: Leslie Calvagne, West Roxbury, MA (US); Yumi Lee, Los Angeles, CA (US); William Liteplo, Cambridge, MA (US); Timothy Higgins, Allston, MA (US); John Fiegener, Marblehead, MA (US); Daniel Armstrong, Newport, KY (US); Michael Tinstman, Revere, MA (US); Jonathan Levy, Gahanna, OH (US)

(73) Assignee: Reebok International Ltd., Canton, MA (US)

( * ) Notice: Subject to any disclaimer, the term of this patent is extended or adjusted under 35 U.S.C. 154(b) by 0 days.

(21) Appl. No.: 12/607,591

(22) Filed: Oct. 28, 2009

(65) Prior Publication Data

US 2010/0113235 A1 May 6, 2010

Related U.S. Application Data

(60) Provisional application No. 61/110,215, filed on Oct. 31, 2008.

(51) Int. Cl.
*A63B 26/00* (2006.01)

(52) U.S. Cl. ..... 482/143

(58) Field of Classification Search ..... 482/143, 482/148, 23–24, 34, 38–39, 51, 91–93, 139, 482/907

See application file for complete search history.

(56) References Cited

U.S. PATENT DOCUMENTS 1,340,904 A * 5/1920 Medart ..... 472/118
1,629,676 A * 5/1927 Buckminster ..... 482/24
1,646,158 A * 10/1927 McWhirter ..... 482/24
3,191,932 A * 6/1965 Brilz ..... 472/118
3,659,594 A * 5/1972 Schwab ..... 606/237
3,874,375 A * 4/1975 Penner ..... 606/241
3,966,202 A * 6/1976 Cynamon ..... 482/56
4,077,403 A * 3/1978 Steele ..... 606/241
4,289,310 A * 9/1981 Weakly ..... 472/118
4,410,175 A * 10/1983 Shamp ..... 482/69
4,477,073 A * 10/1984 Koch et al. ..... 482/91
4,492,373 A * 1/1985 Dzitzer ..... 482/143
4,531,514 A * 7/1985 McDonald et al. ..... 606/241
4,606,539 A * 8/1986 Farnham ..... 482/148
5,167,602 A * 12/1992 Lehktman ..... 482/131
5,186,696 A * 2/1993 Pfefferle et al. ..... 482/40
5,209,712 A * 5/1993 Ferri ..... 482/91
5,569,169 A * 10/1996 Lewark, Sr. ..... 601/134
5,571,064 A * 11/1996 Holm ..... 482/129
5,626,540 A * 5/1997 Hall ..... 482/69

(Continued)

OTHER PUBLICATIONS

SYST/TD Dance Trapeze, www.barry.ca/technical-data-sheet/ft-syst-td-danse-trapeze-an.pdf, viewed Oct. 25, 2008.

*Primary Examiner* — Lori Baker

(74) *Attorney, Agent, or Firm* — Sterne, Kessler, Goldstein & Fox P.L.L.C.

(57) ABSTRACT

An exercise apparatus may include a swivel and one or more elongated members, such as ropes or cords, suspended from the swivel with a support, such as a bar, for the user suspended between either ends of a single elongated member, or between two elongated members. The height of the support can be adjusted by placing ends of the support bar in loops formed along the elongated member. Hand holds and foot holds may also be mounted on the loops. In addition, the support may be prevented from rotating along its longitudinal axis.

19 Claims, 41 Drawing Sheets

U.S. PATENT DOCUMENTS

| | | | | |
|---|---|---|---|---|
| 5,662,555 | A * | 9/1997 | Cloutier | 482/23 |
| 5,944,640 | A * | 8/1999 | Larsson | 482/96 |
| 6,102,837 | A * | 8/2000 | Hubbard | 482/120 |
| 6,113,564 | A * | 9/2000 | McGuire | 602/32 |
| 6,322,483 | B1 * | 11/2001 | Rotella | 482/129 |
| 6,348,026 | B1 * | 2/2002 | Kuo | 482/126 |
| 6,450,929 | B1 * | 9/2002 | Markham | 482/121 |
| 6,790,194 | B1 * | 9/2004 | Katane et al. | 602/36 |
| 6,908,418 | B2 * | 6/2005 | Saure | 482/121 |
| 6,921,354 | B1 * | 7/2005 | Shifferaw | 482/91 |
| 7,044,896 | B2 * | 5/2006 | Hetrick | 482/95 |
| 7,255,666 | B2 * | 8/2007 | Cardenas | 482/143 |
| 7,651,448 | B2 * | 1/2010 | Hetrick | 482/95 |
| 2002/0022555 | A1 * | 2/2002 | Nesci | 482/91 |
| 2009/0264267 | A1 * | 10/2009 | Ballif | 482/139 |
| 2010/0113235 | A1 * | 5/2010 | Calvagne et al. | 482/143 |

* cited by examiner

EXERCISE APPARATUS

CROSS REFERENCE TO RELATED APPLICATIONS

This application claims the benefit of U.S. Application No. 61/110,215, filed on Oct. 31, 2008, which is hereby incorporated by reference in its entirety.

BACKGROUND OF THE INVENTION

1. Field of the Invention

The disclosed invention relates to an exercise apparatus, and more particularly to a trapeze for exercise.

2. Background Art

Trapeze is a term commonly used to refer to a short horizontal bar hung between two ropes or cords suspended from above. Trapezes are typically used by acrobats and aerialists in circus and dance performances. Their movement is typically from front to back and they are mounted high enough off the floor so that the user can swing from the trapeze without touching the ground. A variation of the traditional trapeze is the dance trapeze, or single-point trapeze, which is a low mounted trapeze used by modern dance companies in aerial dance. The ropes of the dance trapeze can be joined together at a swivel to allow the trapeze to spin or rotate. The dance trapeze may be mounted close enough to the ground to allow the user to grab the bar while standing on the ground. Recently, there has been an interest in using both the traditional trapeze and the dance trapeze as a part of an exercise routine. However, the single fixed-height, suspended trapeze bar, limits the exercise options available with known trapeze devices. Having an ability to change the bar height or bar configuration would greatly increase the variety of exercises which could be accomplished on the equipment. It is also desirable, in some cases, to prevent the bar from rotating while it is in use so that it is more stable for the user.

BRIEF SUMMARY OF THE INVENTION

The present invention is a user configurable trapeze exercise apparatus that provides the user with almost limitless opportunities to customize the apparatus to their exercise needs by varying the bar height, the number of bars, or even removing the bar altogether, depending upon such factors as the user's height and the area of the body the user desires to exercise. It also provides the user with the ability to perform a wide variety of exercises using a single piece of equipment. In some embodiments, the disclosed exercise apparatus includes a suspended bar at a user configurable height, wherein the suspended bar is prevented from rotation about its longitudinal axis. In some embodiments, the disclosed exercise apparatus includes a rotation mechanism by which the apparatus can be rotated about a vertical axis or about an axis of the apparatus so that the exercise apparatus may be used to perform exercises that involve twisting or turning.

In one embodiment, the exercise apparatus includes a rotation mechanism; a first elongated member connected to the rotation mechanism; a second elongated member connected to the rotation mechanism; at least two attachment points disposed on the first elongated member; at least two attachment points disposed on the second elongated member; and a support. The support can include a first end and a second end, wherein the first end is removably attached to an attachment point on the first elongated member and the second end is removably attached to an attachment point on the second elongated member.

In another embodiment, the exercise apparatus includes a first elongated member comprising at least one attachment point; a second elongated member comprising at least one attachment point; and a support. The support can include a bar having a first end and a second end; wherein the first end comprises an anti-rotation feature and is attached to the at least one attachment point of the first elongated member in a manner that prevents the bar from rotating about its longitudinal axis, wherein the second end comprises an anti-rotation feature attached to the at least one attachment point of the second elongated member in manner that the support is prevented from rotating about its longitudinal axis. For example, the support can include a first cap attached to the first end of the bar, wherein the first cap comprises an anti-rotation feature attached to the at least one attachment point of the first elongated member, and a second cap attached to the second end of the bar, wherein the second cap comprises an anti-rotation feature attached to the at least one attachment point of the second elongated member.

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention. Dimensions shown in the figures are merely exemplary and other dimensions would be apparent to those of ordinary skill in the art.

DETAILED DESCRIPTION OF THE INVENTION

The present invention will be described with reference to the accompanying drawings. The Figure in which an element first appears is typically indicated by the leftmost digit(s) in the corresponding reference number.

While specific configurations and arrangements are discussed, it should be understood that this is done for illustrative purposes only. A person skilled in the pertinent art will recognize that other configurations and arrangements can be used without departing from the spirit and scope of the present invention. It will be apparent to a person skilled in the pertinent art that this invention can also be employed in a variety of other applications.

In the detailed description of the invention that follows, references to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Figure 1:
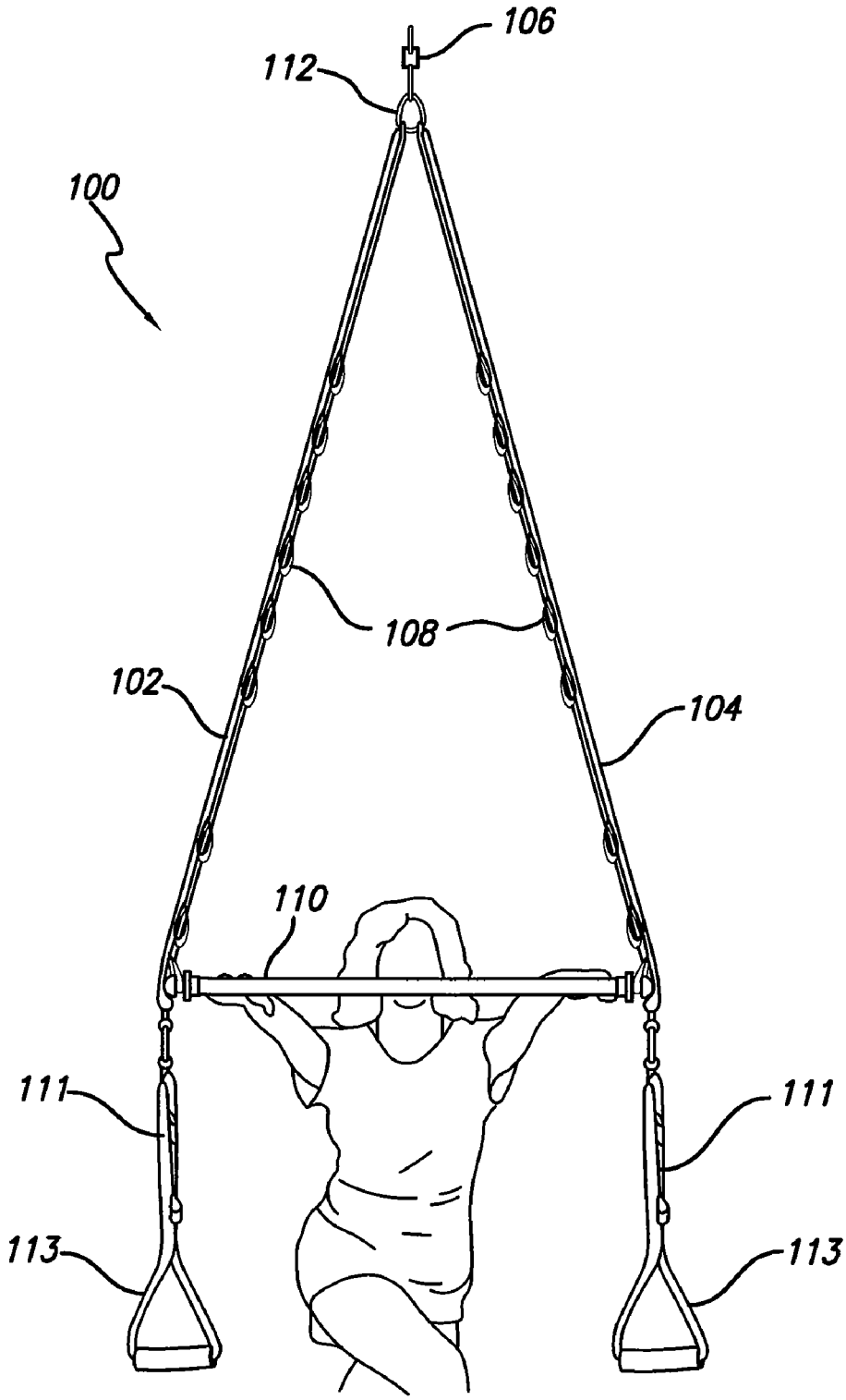
FIG.1 is an exemplary embodiment of an exercise apparatus according to the present invention.

An exemplary exercise apparatus 100 is shown in FIG. 1 having a first vertical support or elongated member 102 and a second vertical support or elongated member 104 joined together by a connector 112, which in this embodiment is a carabiner, which is connected to a swivel or rotation mechanism 106. Rotation mechanism 106 may be suspended from a ceiling, wall, or other support so that exercise apparatus 100 is suspended above the floor or other surface on which a user will stand to use the apparatus. First and second elongated members 102, 104 each have one or more attachment points 108 to which a variety of exercise devices may be removably connected to apparatus 100. One example of such an exercise device is bar or support 110. Other examples include foot holds 113, hand hold 838, or elongated extension members which themselves may include additional attachment points or foot or hand holds.

Figure 9:
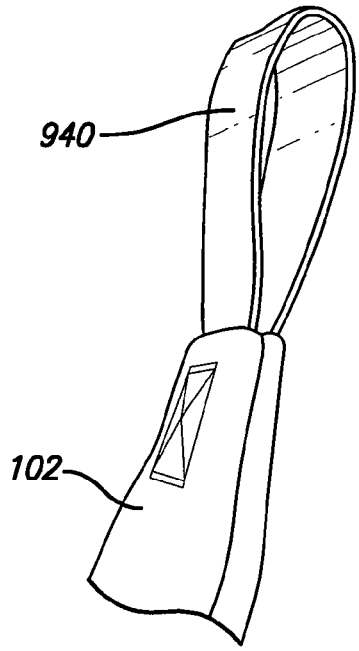
FIG. 9 is an exemplary end of an elongated member of FIG. 1.

First and second elongated members 102, 104 may be directly connected to rotation mechanism 106, or indirectly connected to rotation mechanism 106 via a loop, ring, clip, carabiner or other similar structure 112 attached to rotation mechanism 106. An end of first and second elongated members 102, 104 may have a loop 940 (as shown in FIG. 9) that is utilized to make the connection to rotation mechanism 106. Rotation mechanism 106 may be mounted to a ceiling, wall, or other structure such that exercise apparatus 100 may rotate about a vertical axis or about an axis of exercise apparatus 100 to permit exercises that involving twisting or turning. An exemplary rotation mechanism 106 may be a swivel such as, but not limited to, a ball bearing swivel. Examples of suitable swivels include those available from the Petzl Company of Crolles, France.

Figure 2:
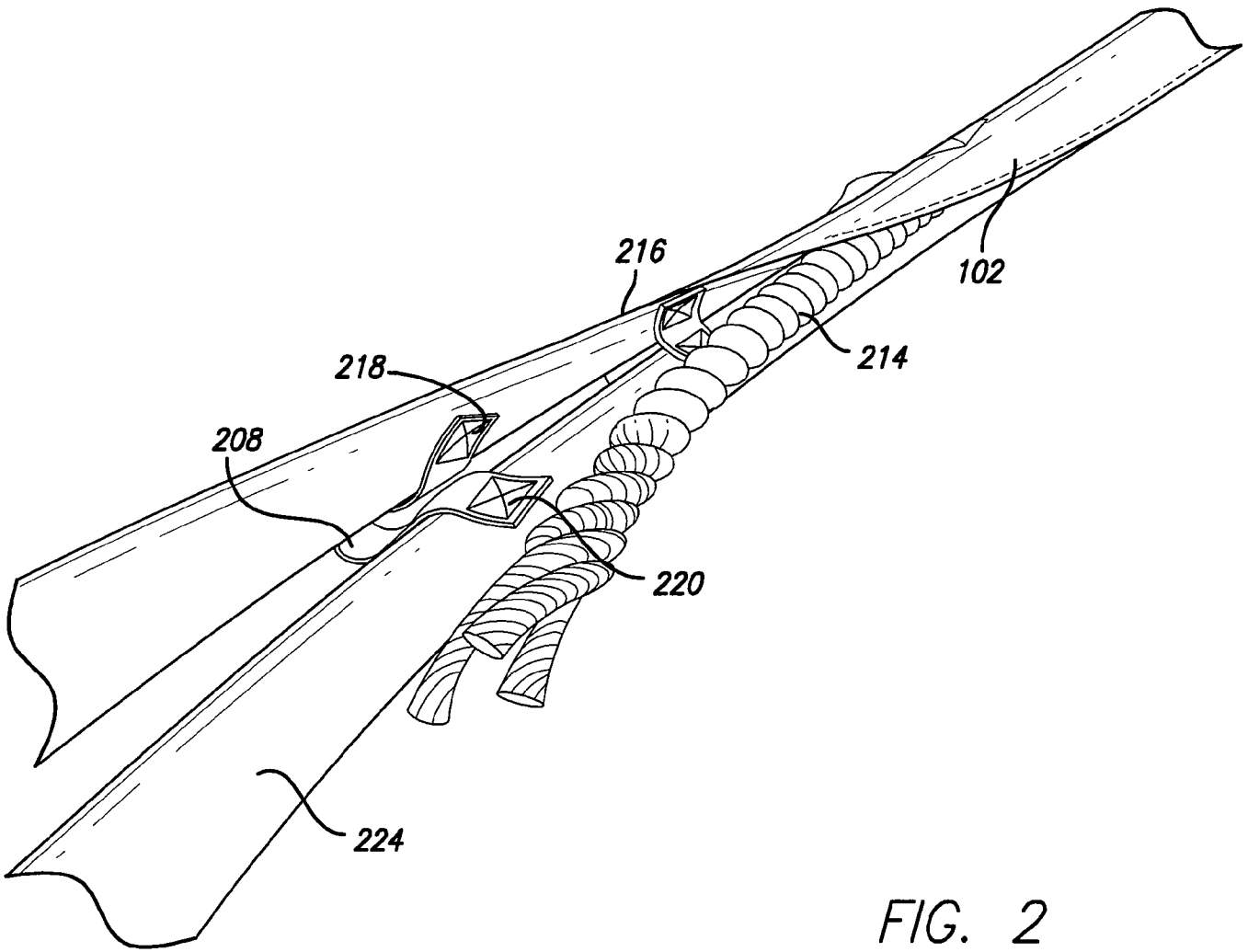
FIG. 2 is a partially exploded view of an exemplary elongated member of FIG. 1.

Each elongated member 102, 104 may be made of rope such as braided or twisted fiber or cord, including rope composed of synthetic fiber (e.g., nylon), natural fiber (e.g., cotton) or a combination thereof. As shown in FIG. 2, each elongated member 102, 104 may have a core 214 and a sheath 216 surrounding core 214. In one embodiment, core 214 may be rope, such as a braided or twisted rope. Core 214 may include any type of rope known in the art such as rope composed of synthetic fiber, natural fiber, or a combination thereof, including, but not limited to, nylon rope or cotton rope. In some embodiments, core 214 may be a twisted rope and may have a diameter between about one-quarter inch and about 2 inches. In one particular embodiment, core 214 may be a twisted cotton with a diameter of about one inch.

The material for sheath 216 may be selected from one or materials that may be treated (e.g., surface treated) to prevent moisture, dirt, or other contaminants from reaching or penetrating core 214. In addition, the material for sheath 216 may be selected to allow easy cleaning or disinfecting of elongated members 102, 104. Sheath 216 may be polyester webbing attached together along its edges to surround core 214. For example, sheath 216 may be two or more pieces of polyester webbing attached together along their edges to surround core 214. In one embodiment, sheath 216 may be wrapped around core 214 and then the ends of sheath 216 are stitched or bonded to surround core 214. In another embodiment, the sheath 216 may be formed into a tube and the core 214 is pulled through the tube. The sheath 216 may be textured to increase the tactile experience of a user of the equipment. In one embodiment, the sheath 216 may be a polymer coating or a textured coating applied to a rope core. In other embodiments, the sheath 216 may include fabric or webbing. For example, sheath 216 may include a synthetic webbing such as a nylon or polyester webbing. Suitable webbing can include webbing having a width between about 1 inch and about 4 inches. In some embodiments, sheath 216 may include two or more pieces of joined webbing. In one embodiment, sheath 216 may be an about two inch wide polyester webbing having a thickness of about 0.040 inch and a rating of about 2600 pounds available as product code E116 from Bainbridge International of England.

Figure 10:
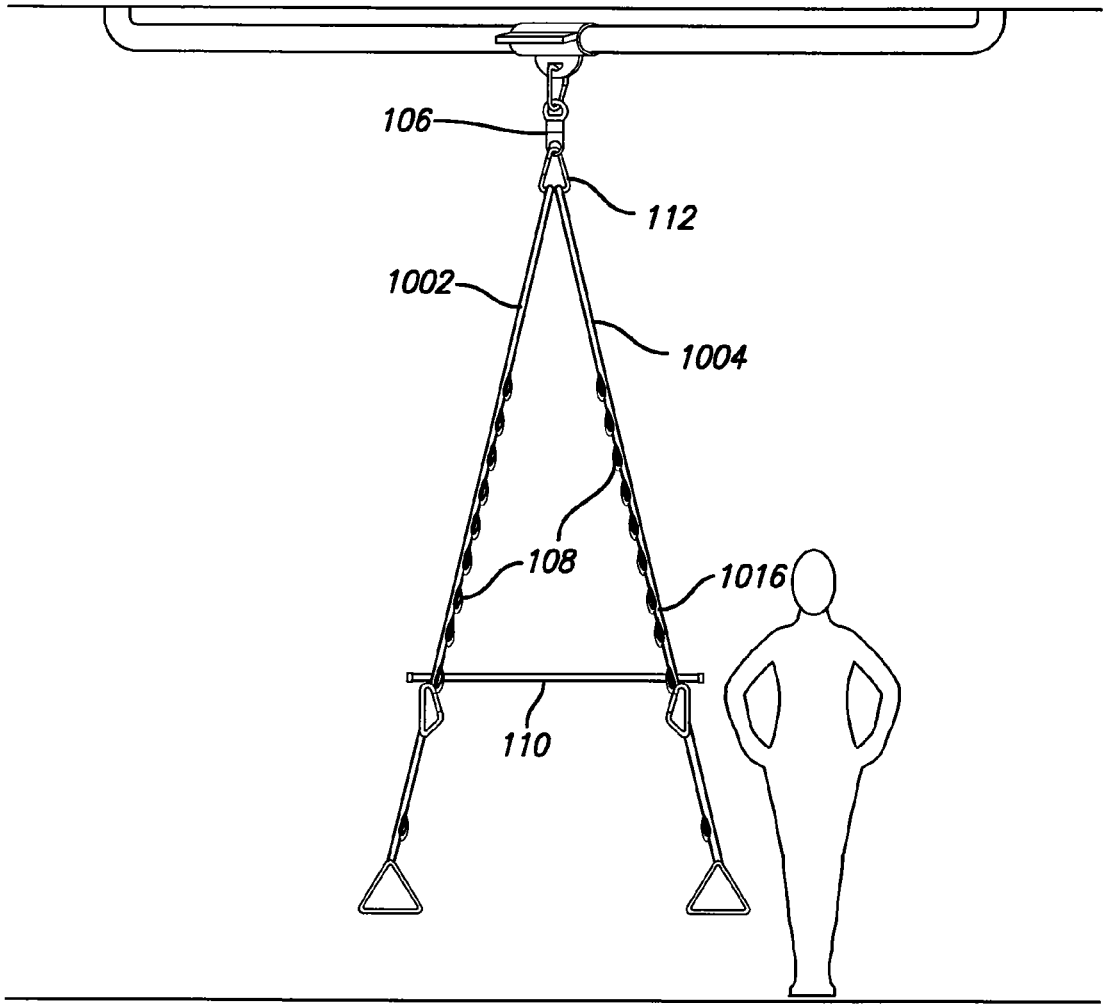
FIG. 10 is another exemplary embodiment of an exercise apparatus according to the present invention.
Figure 11:
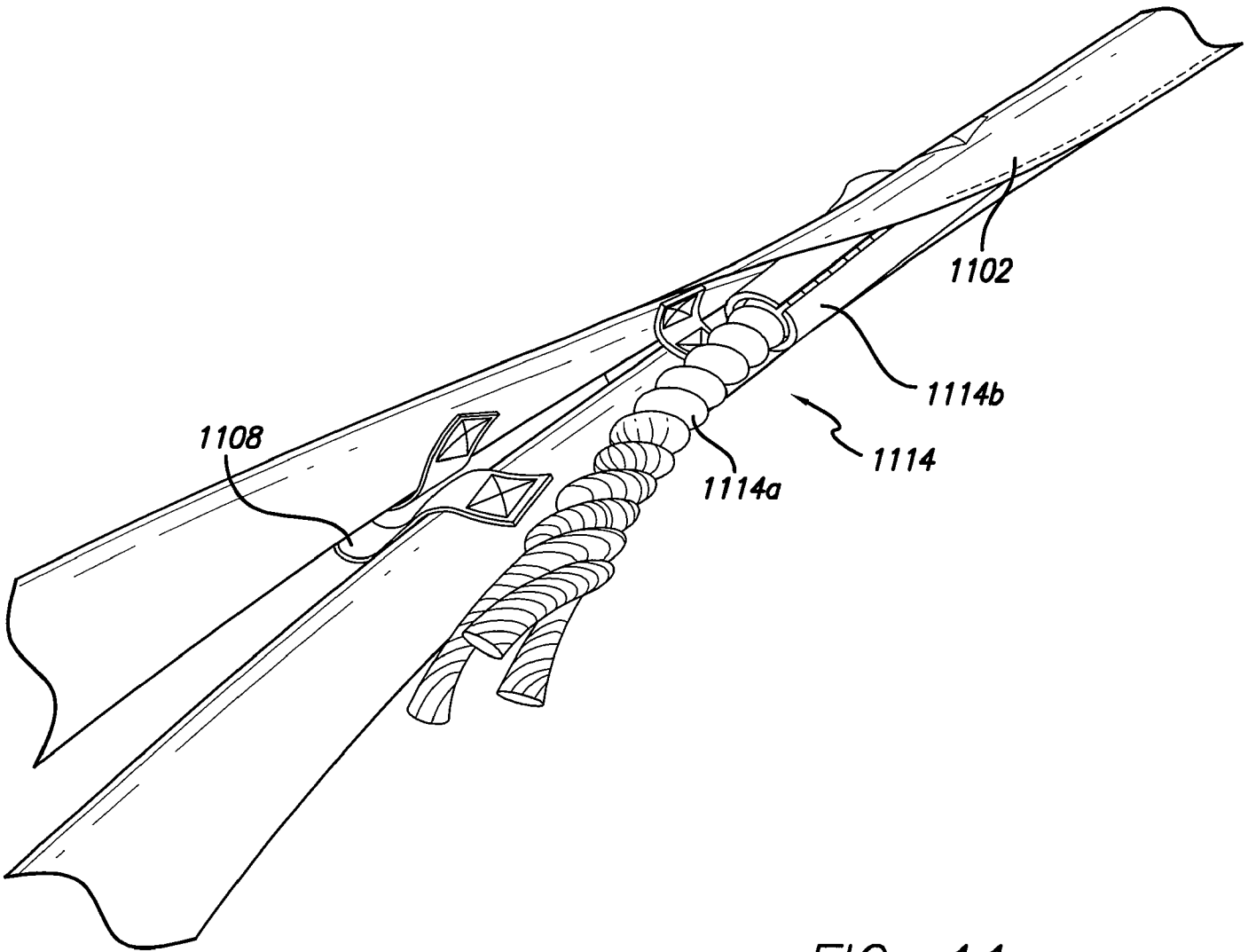
FIG. 11 is a partially exploded view of another exemplary elongated member.
Figure 12:
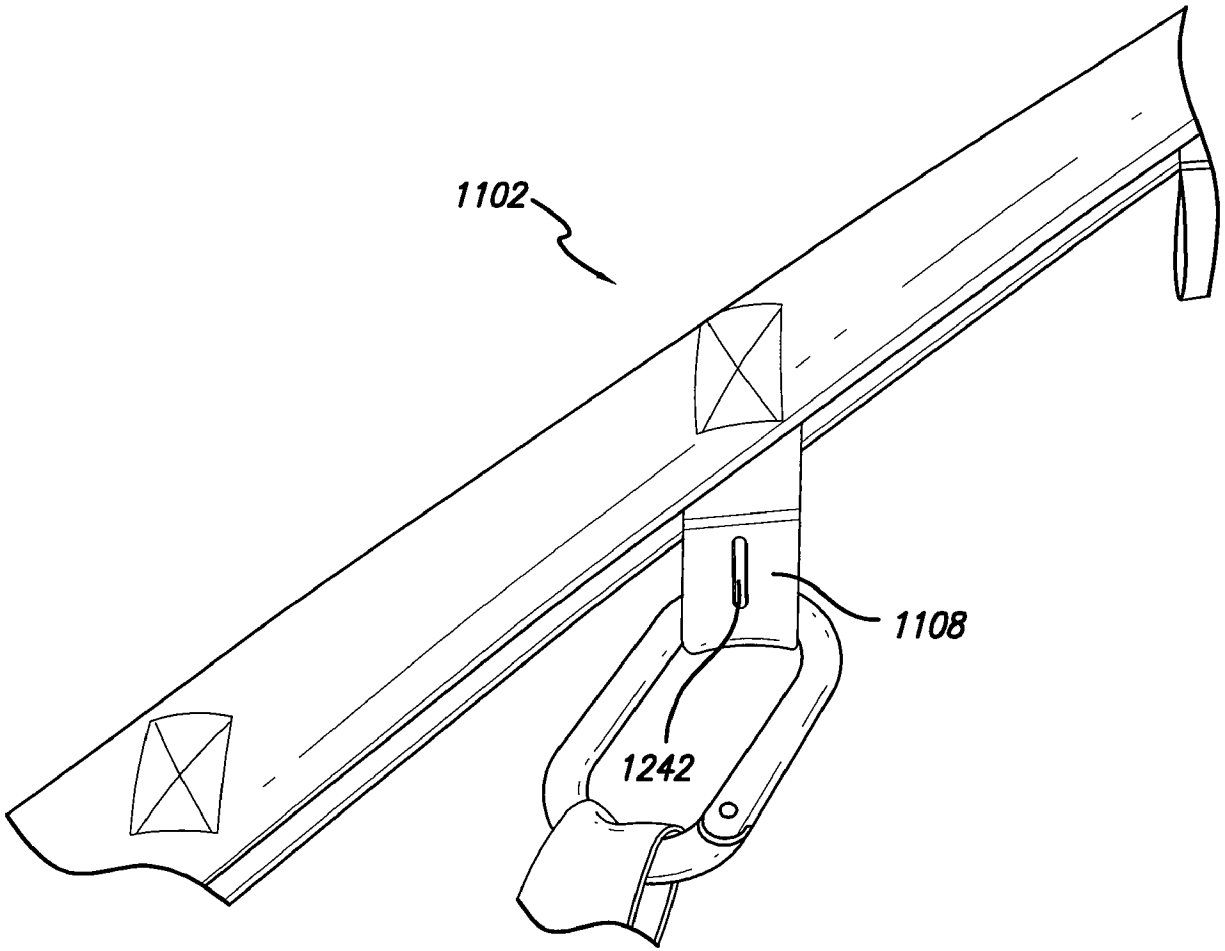
FIG. 12 is a close up view of another exemplary attachment point.
Figure 13:
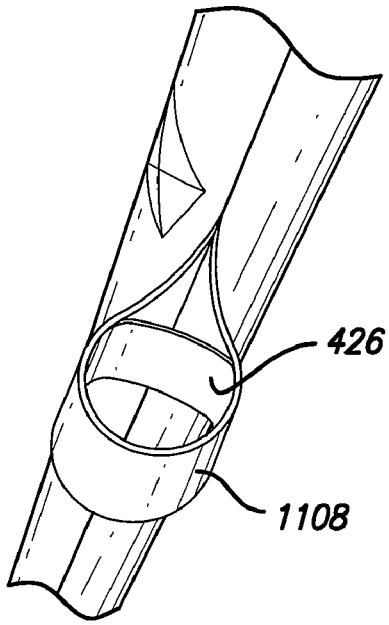
FIG. 13 is a perspective view of the exemplary attachment point of FIG. 12.
Figure 14:
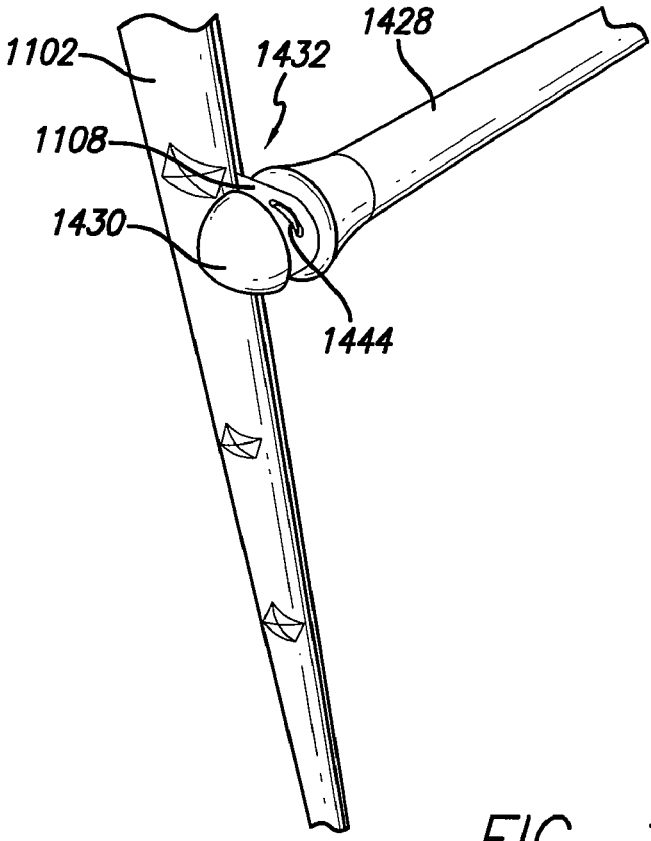
FIG. 14 is a close up view thereof.

In other embodiments, core 214 may be wire, fabric, webbing, chain (e.g., metal or plastic chain), or combinations thereof and sheath 216 surrounding core 214 may be rope, fabric, or webbing. For example, elongated members 102, 104 may have a core 214 of webbing surrounded by a sheath 216 of rope, fabric, or webbing. In another example, as shown in FIG. 10, the core (not shown) may be webbing and the sheath 1016 may be twisted rope having a diameter between about 0.25 and about 2 inches, such as twisted rope having a diameter of about ⅞ inches, forming an elongated member 1002, 1004 with a total diameter from about 0.5 to about 3 inches or about 0.5 to about 1.5 inches, such as about 1 inch to about 1 and ⅛ inches. Also, padding (e.g. foam, rubber, cotton, synthetic, or textile padding) may be located between the core and any sheathing of the elongated members.

In some embodiments, core 214 of elongated members 102, 104 may act as a load bearing component. For example, core 214 of elongated members 102, 104 may bear the full weight of the user of the exercise apparatus. Examples of suitable materials for such a core include stranded rope, webbing such as parachute webbing, and metal or wire cable.

In other embodiments, sheath 216 of elongated members 102, 104 may act as a load bearing component. For example, sheath 216 of elongated members 102, 104 may bear the full weight of the user of the exercise apparatus. Examples of suitable materials for such a sheath include nylon webbing (e.g., about 2 inch wide nylon webbing rated for anywhere from about 2,400 to about 4,800 lbs) or polyester webbing (e.g., about 2 inch wide polyester webbing rated for anywhere from about 2,400 to about 10,000 lbs.). In some embodiments, elongated members 102, 104 do not contain a core material and instead comprise a tube of load bearing material such as a tube of nylon or polyester webbing. Examples of suitable nylon or polyester webbings have thicknesses from about 0.050 inch to about 0.075 inch and widths of about 2 inches, although smaller or larger thicknesses and widths may be utilized.

Each elongated member 102, 104 includes one or more attachment points 108 to which a variety of exercise devices may be removably connected. For example, in FIG. 1, each elongated member 102,104 has eight attachment points 108. Each end of support 110 may be removably connected to any of the attachment points 108 on each elongated member 102, 104. As shown in FIG. 1, support 110 may be mounted in a horizontal position using attachment points 108 which are opposite to each other. Alternatively, support 110 may be mounted at an angle using attachment points 108 which are offset from each other. Additional elongated member 110 may be removably connected to any of attachment points 108 so that multiple supports 110 are mounted on elongated members 102, 104.

Figure 8:
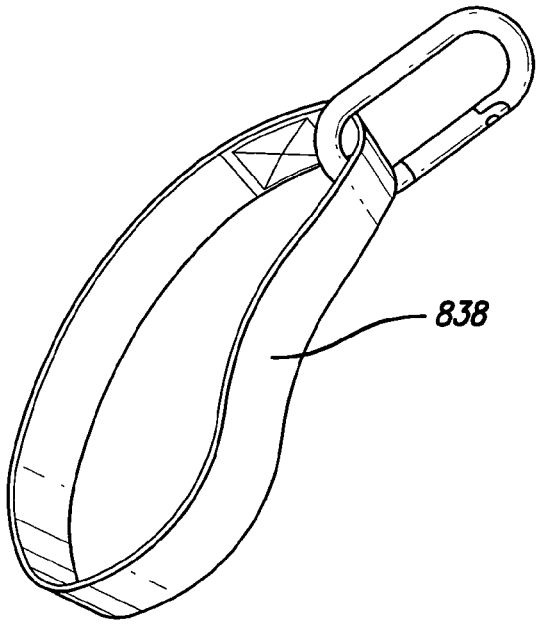
FIG. 8 is an exemplary removable hand or foot hold.

In addition, foot or hand loops 838, as shown in FIG. 8, may be mounted to attachment points 108 along elongated members 102, 104. An elongated extension member 111 that includes a foot loop 113 can also be attached to elongated members 102, 104 to provide the user with a foot support. An elongated extension member 111 can have the same construction as the elongated members 102, 104 or could be of a different construction. For example, elongated extension member 111 could include a strap or a rope. Elongated extension member 111 may also include one or more attachment points 108 for mounting a support 110 or for attaching a hand hold such as hand loop 838.

Attachment points 108 may include loops 208 of webbing or other fabric having a first end 218, a second end 220, and a looping portion 322. For example, in the case of elongated members 102, 104 having core 214 surrounded by a sheath 216, the webbing or other fabric used for loops 208 could be made of the same material as sheath 216. Suitable materials include nylon or polyester webbing. Suitable webbing width can range, for example, from about 0.75 inch to about 1 inch, although other widths can also be used. In one embodiment, an about 0.75 inch wide nylon webbing having a thickness from about 0.070 inch to about 0.075 inch and a rating of about 2775 pounds can be used. Such a material may also be used for other loops associated with the elongated members 102, 104 including a foot or hand loop or the end loop 940.

Figure 3:
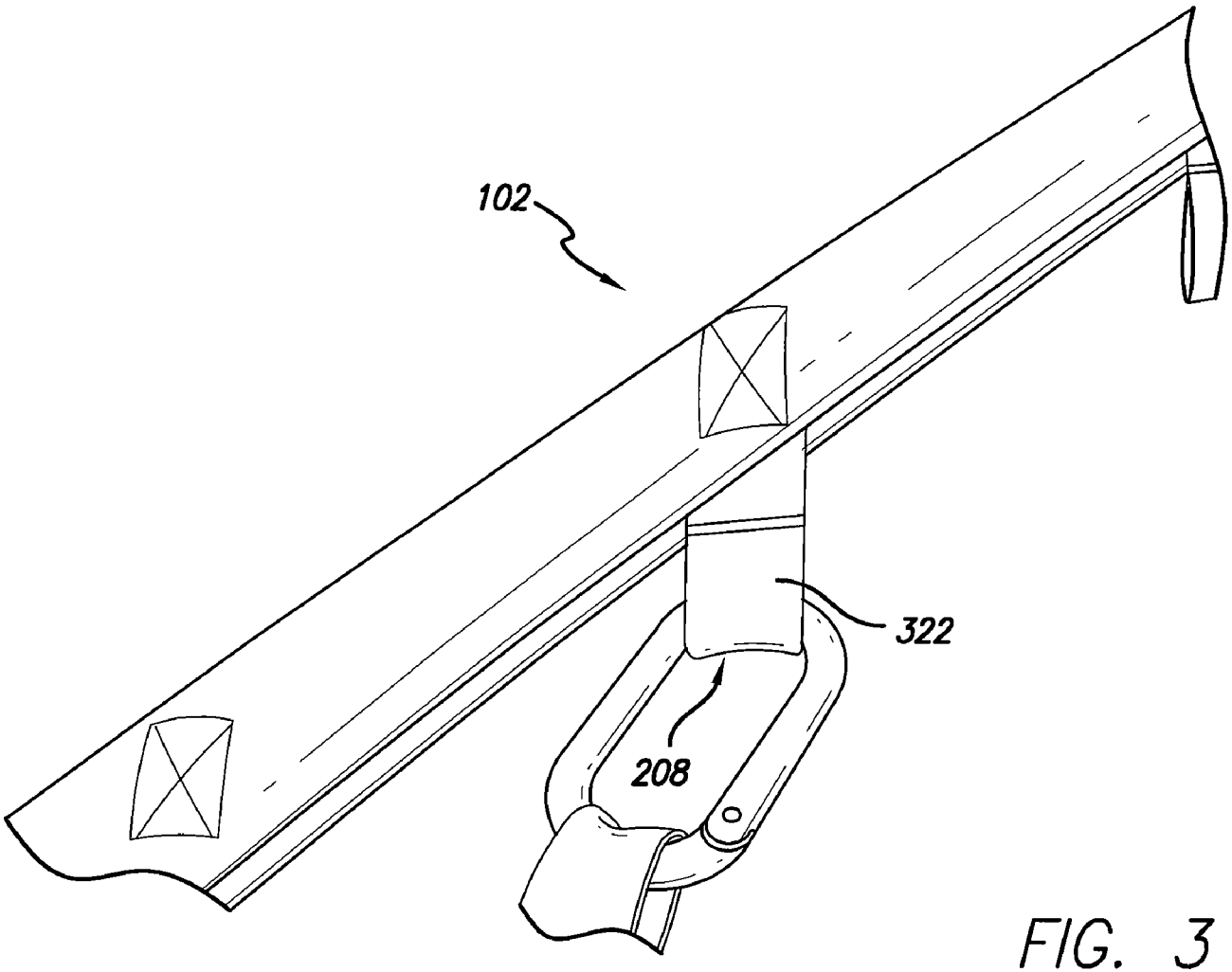
FIG. 3 is close up view of an exemplary attachment point of FIG. 1.
Figure 4:
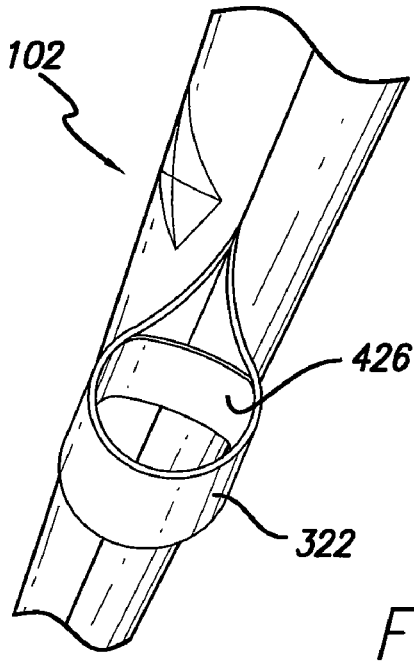
FIG. 4 is a perspective view of an exemplary attachment point of FIG. 3.
Figure 5:
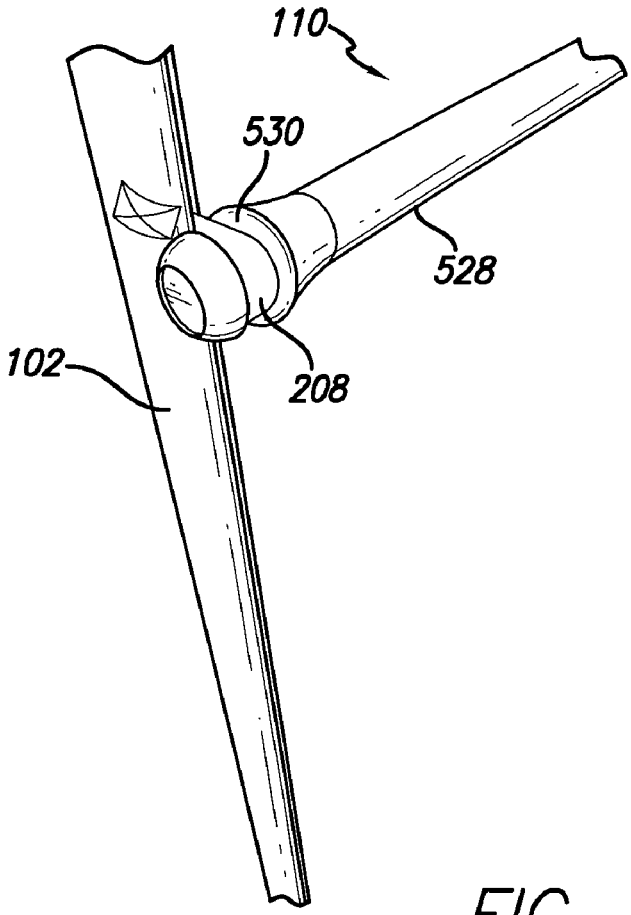
FIG. 5 is a close up view thereof.

Any loops of webbing or other fabric may be attached to sheath 216 before it is used to cover core 214 or they may be attached to sheath 216 after it has been applied to core 214. In some embodiments, as shown in FIG. 3, two pieces of sheath 216 (e.g., nylon or polyester webbing) can be stitched or bonded flat along one side edge. First and second ends 218, 220 of loop 208 can then be stitched or bonded to sheath 216 (e.g., with acrobatic stitching) on an inner surface 224. The other edges of sheath 216 are stitched or bonded closed to form a tube wherein loop portion 322 extends outwardly from sheath 216. An inner surface of loop portion 322 may have an elastic strip 326 attached thereto to aid in retaining any additional exercise members that may be inserted in loop portion 322, such as a support 110. The elastic strip 326 may provide a textured surface to provide a friction fit and prevent movement of support 110 with respect to loop 208. Loops 208 may provide an attachment point for an additional exercise member to be removably connected to elongated members 102, 104, as discussed above, and alternatively, or in addition, may act as a hand or foot hold for the user of the exercise apparatus.

In one embodiment, exercise apparatus 100 has a plurality of attachment points 108, such as loops 208, so that exercise apparatus 100 is user configurable and provides the user with almost limitless opportunities to customize the apparatus to the user's individual exercise needs. For instance, a support 110, such as a bar, may be attached at a variety of attachment points 108 along the length of elongated members 102, 104 depending upon the height of the user or the part of the body the user desires to exercise, thereby making exercise apparatus 100 customizable. Exercise apparatus 100 also provides the user with the ability to perform a wide variety of exercises using a single piece of equipment.

For example, a user may hang, sit, stand, or otherwise support their weight on support 110. Support 110 may be a bar 528 having a cap 530 at each end. In one embodiment, each cap 530 of bar 528 is removably connected to an attachment point 108, such as a loop 208, on each of elongated members 102, 104. Bar 528 can be constructed of a solid or hollow metal (e.g., steel) tube. Alternatively or in addition, bar 528 can include wood, plastic, or composite materials. For example, in some embodiments, bar 528 can include fiberglass or carbon fiber composite. Bar 528 can include a rubber or foam coating for improved grip. While bar 528 is shown as being straight, it may also have a contoured shape. In some embodiments, cap 530 slides over the outer diameter of the ends of bar 528. In some embodiments, cap 530 is threaded and screws onto ends of bar 528. In some embodiments, cap 530 includes anti-rotation features or elements to prevent bar 528 from rotating about its longitudinal axis when it is connected to attachment points 108 on each of elongated members 102, 104. In other embodiments, the support includes a bar and the bar includes integral anti-rotation features or elements to prevent the support from rotating about its longitudinal axis when it is connected to attachment points 108 on each of elongated members 102, 104. For example, the support can include a bar having a first end and a second end, wherein the first end comprises an anti-rotation feature and is attached to an attachment point of the first elongated member in a manner that prevents the bar from rotating about its longitudinal axis and the second end comprises an anti-rotation feature and is attached to an attachment point of the second elongated member in a manner that prevents the bar from rotating about its longitudinal axis.

Figure 6:
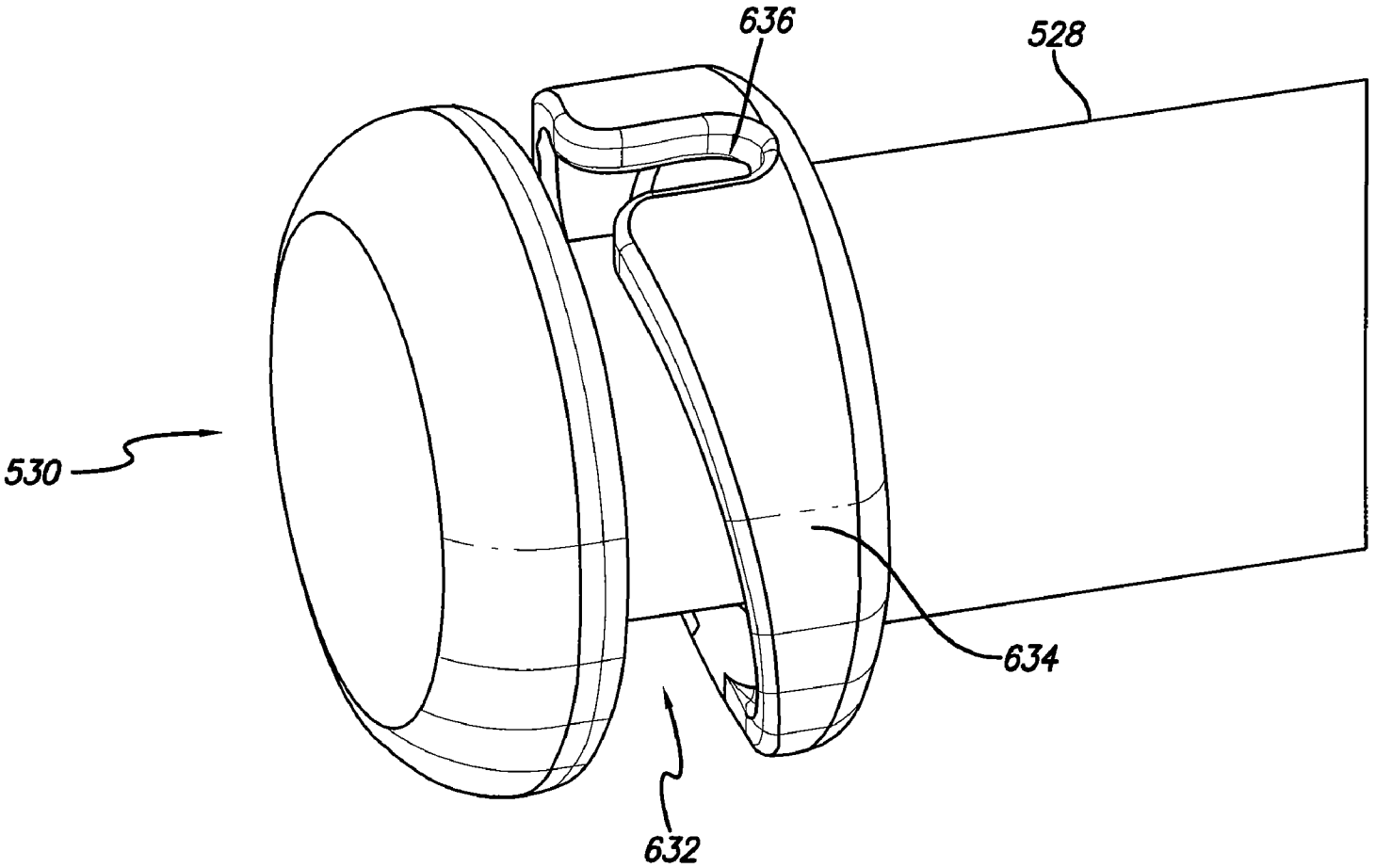
FIG. 6 is perspective view of an exemplary end cap for an exemplary support.
Figure 7:
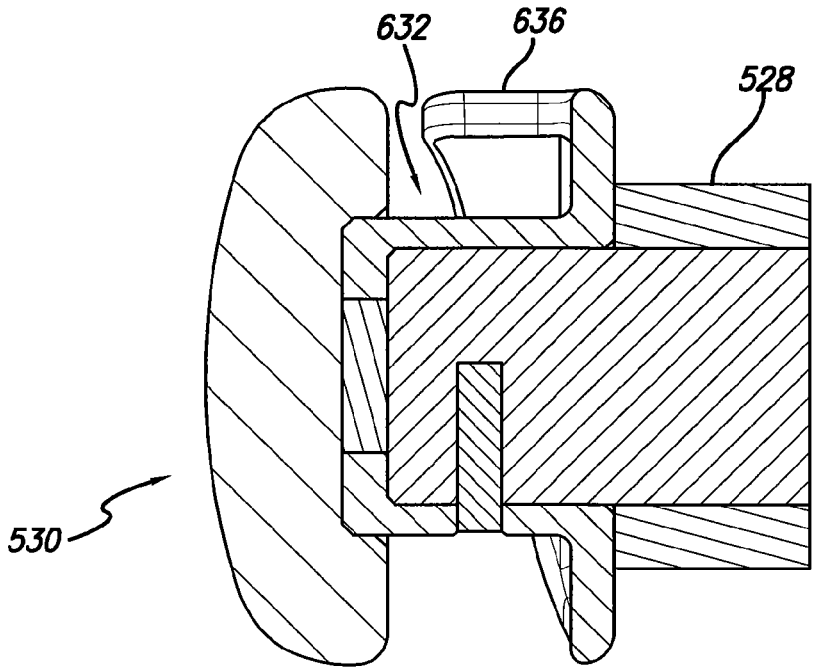
FIG. 7 is a cross-sectional view of the exemplary end cap shown in FIG. 6.

In one embodiment, as shown in FIGS. 6-7, each end cap 530 has a channel 632 around its periphery that receives a loop 208. A wall 634 defines at least part of channel 632 and wall 634 may have a groove 636 that holds loop 208 in place in channel 632 to prevent bar 528 from rotating along its longitudinal axis. In one embodiment, wall 634 may gradually slope upwardly towards either side of groove 636. The groove 636 may hold loop 208 in place to prevent relative movement between loop 208 and end cap 530, thereby preventing bar 528 from rotating. In other embodiments, the support can include a bar having a first end and a second end and each end of the bar has a channel around its periphery that can receive a loop 208. As discussed below with respect to FIGS. 11-19, the bar may have a plurality of features for receiving a loops.

In another embodiment, as shown in FIGS. 11-14, each loop 1108 on elongated member 1102 may have a slot 1242 that receives a protrusion 1444 of an end cap 1430 or a protrusion of a bar end. End cap 1430 may have a channel 1432 that receives loop 1108 and protrusion 1444 may extend outwardly from channel 1432 and may be inserted in slot 1242 of loop 1108 to hold bar 1428 in place and prevent bar 1428 from rotating. Similarly, a bar end may have a channel that receives loop 1108 and a protrusion of the bar end may extend outwardly from the channel and may be inserted in slot 1242 of loop 1108 to hold the bar in place and prevent the bar from rotating. Elongated member 1102 may have a core 1114 that includes a twisted rope 1114*a* surrounded by rubber foam padding 1114*b*.

Figure 15:
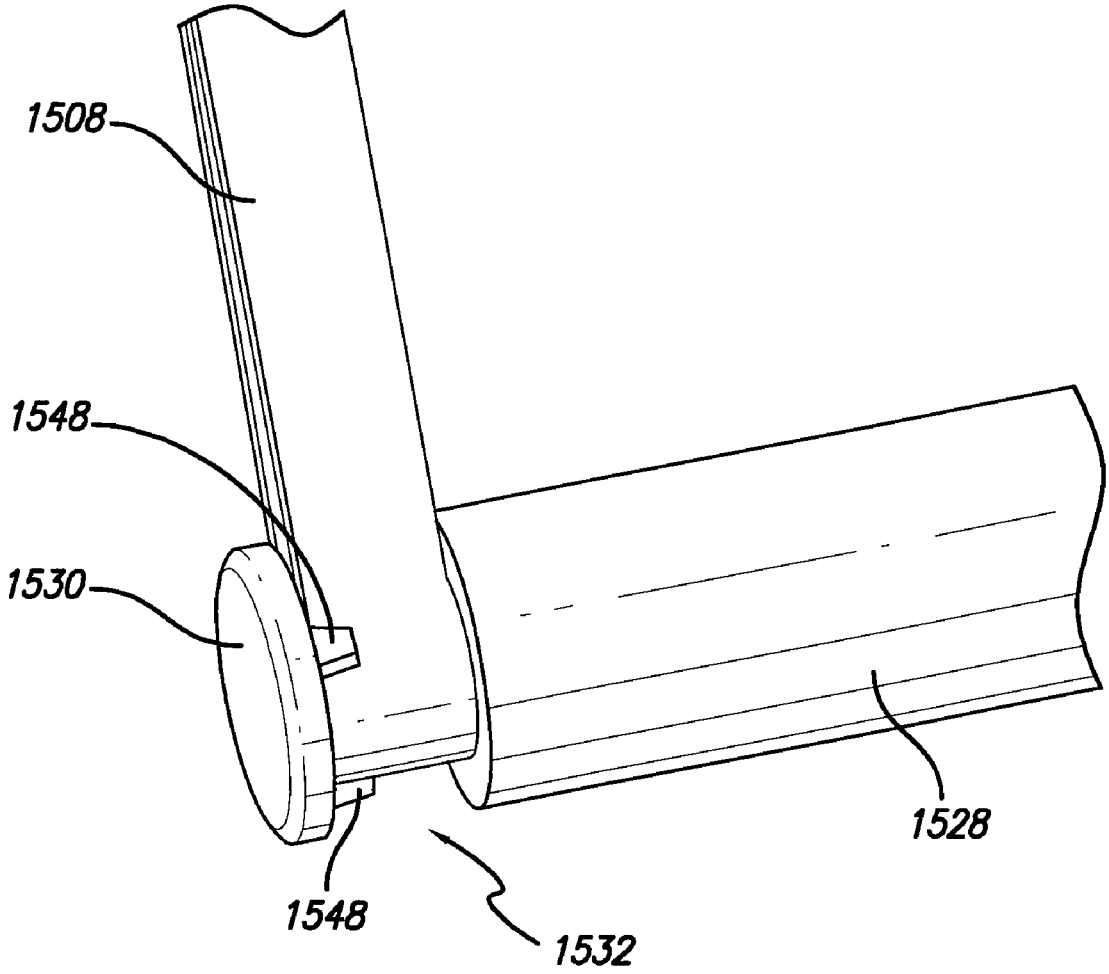
FIG. 15 is an exemplary embodiment of an end cap.

In another embodiment, as shown in FIG. 15 the end cap 1530 may screw onto the bar 1528. End cap 1530 may have a channel 1532 for receiving a loop 1508 and one or more extensions 1548 extending into channel 1532 that hold loop 1508 in place to prevent bar 1528 from rotating. End cap 1530 is turned until loop 1508 is tightly sandwiched between end cap 1530 and bar 1528. Extensions 1548 may be a plurality of spaced apart nubs. The nubs may hold loop 1508 in place to prevent relative movement between loop 1508 and end cap 1530, thereby preventing bar 1528 from rotating.

Figure 16:
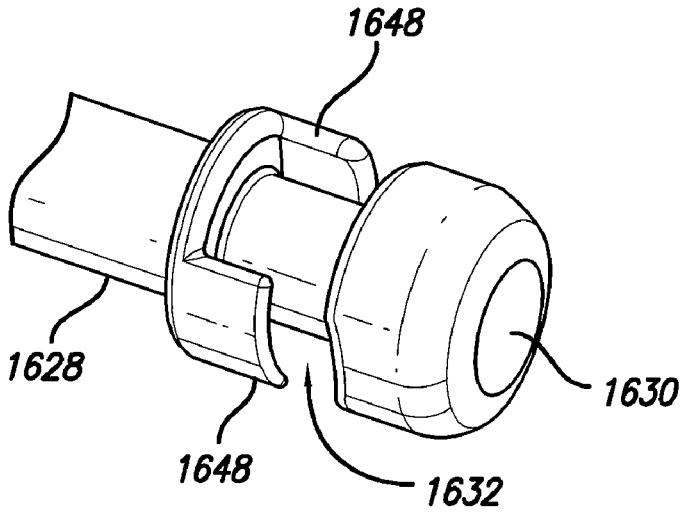
FIG. 16 is another exemplary embodiment of an end cap.
Figure 17:
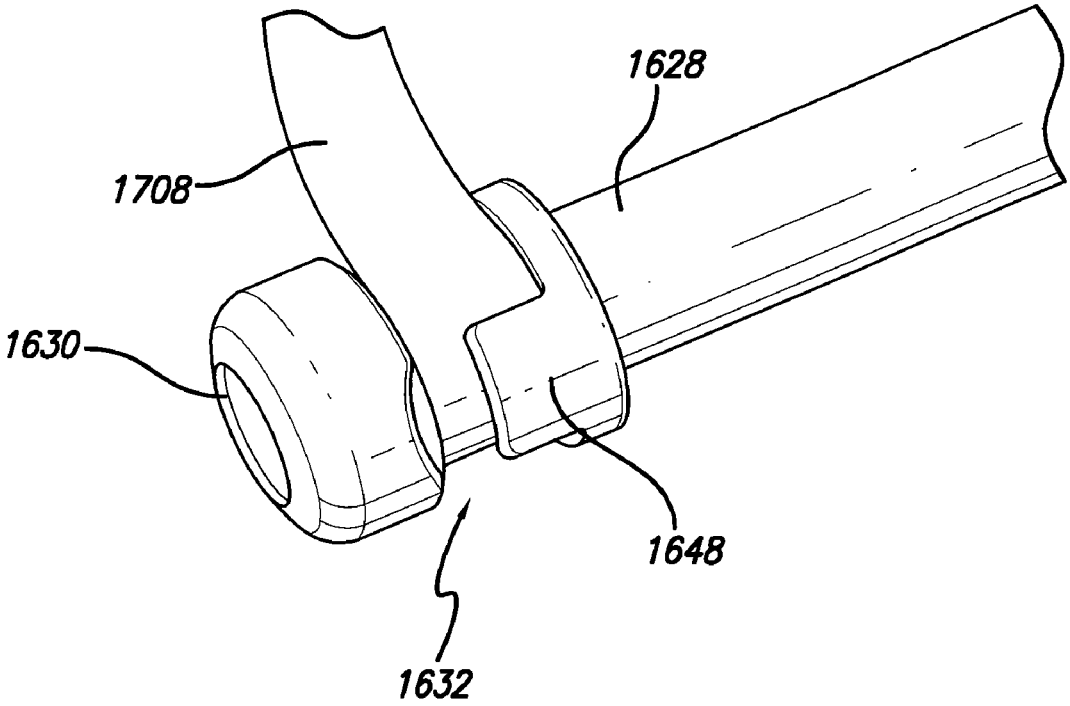
FIG. 17 is the end cap of FIG. 16 with a loop attached thereto.

In another embodiment, as shown in FIGS. 16-17 the end cap 1630 may screw onto the bar 1628. End cap 1630 may have a channel 1632 for receiving a loop 1708 and one or more extensions 1648 extending into channel 1632 that hold loop 1708 in place to prevent bar 1628 from rotating. End cap 1670 is turned until loop 1708 is tightly sandwiched between end cap 1630 and bar 1628. Extensions 1648 may be a two or more flanges. The flanges may hold loop 1708 in place to prevent relative movement between loop 1708 and end cap 1630, thereby preventing bar 1628 from rotating.

Figure 18:
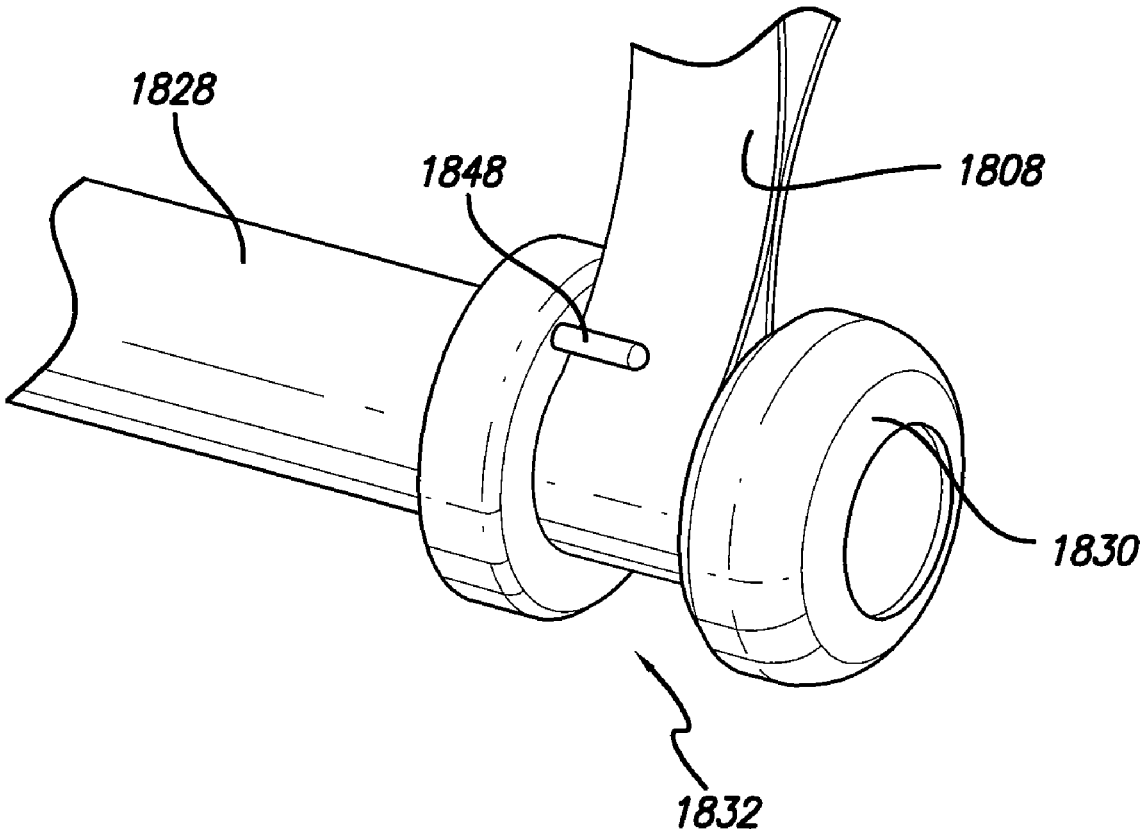
FIG. 18 is another exemplary embodiment of an end cap.

In another embodiment, as shown in FIG. 18 the end cap 1830 may screw onto the bar 1828. End cap 1830 may have a channel 1832 for receiving a loop 1808 and one or more extensions 1848 extending into channel 1832 that hold loop 1808 in place to prevent bar 1828 from rotating. End cap 1870 is turned until loop 1808 is tightly sandwiched between end cap 1830 and bar 1828. Extensions 1848 may be two or more pins. The pins may hold loop 1808 in place to prevent relative movement between loop 1808 and end cap 1830, thereby preventing bar 1828 from rotating.

Figure 19:
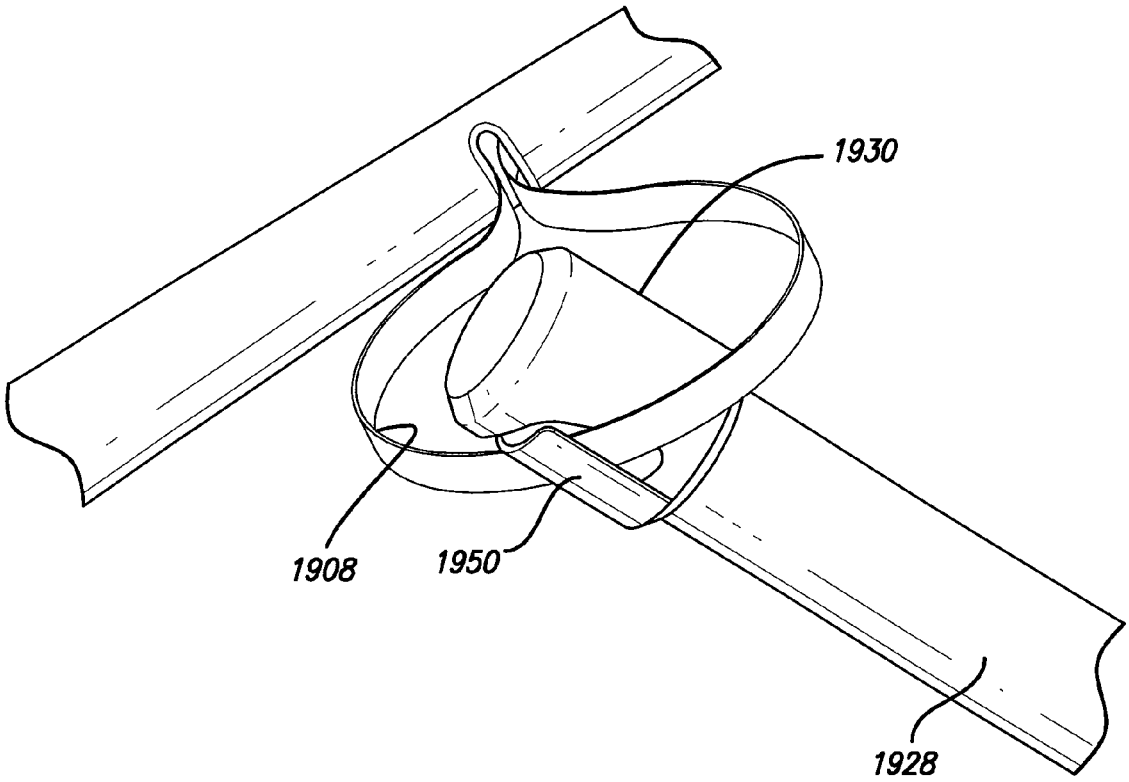
FIG. 19 is another exemplary embodiment of an end cap.

In another embodiment, as shown in FIG. 19, the end cap 1930 may have a clip 1950 that receives the loop 1908 and a portion of clip 1950 may have a hook (not shown) that catches loop 1908 and holds it in place to prevent bar 1928 from rotating. The hook may hold loop 1908 in place to prevent relative movement between loop 1908 and end cap 1930, thereby preventing bar 1628 from rotating.

Figure 20:
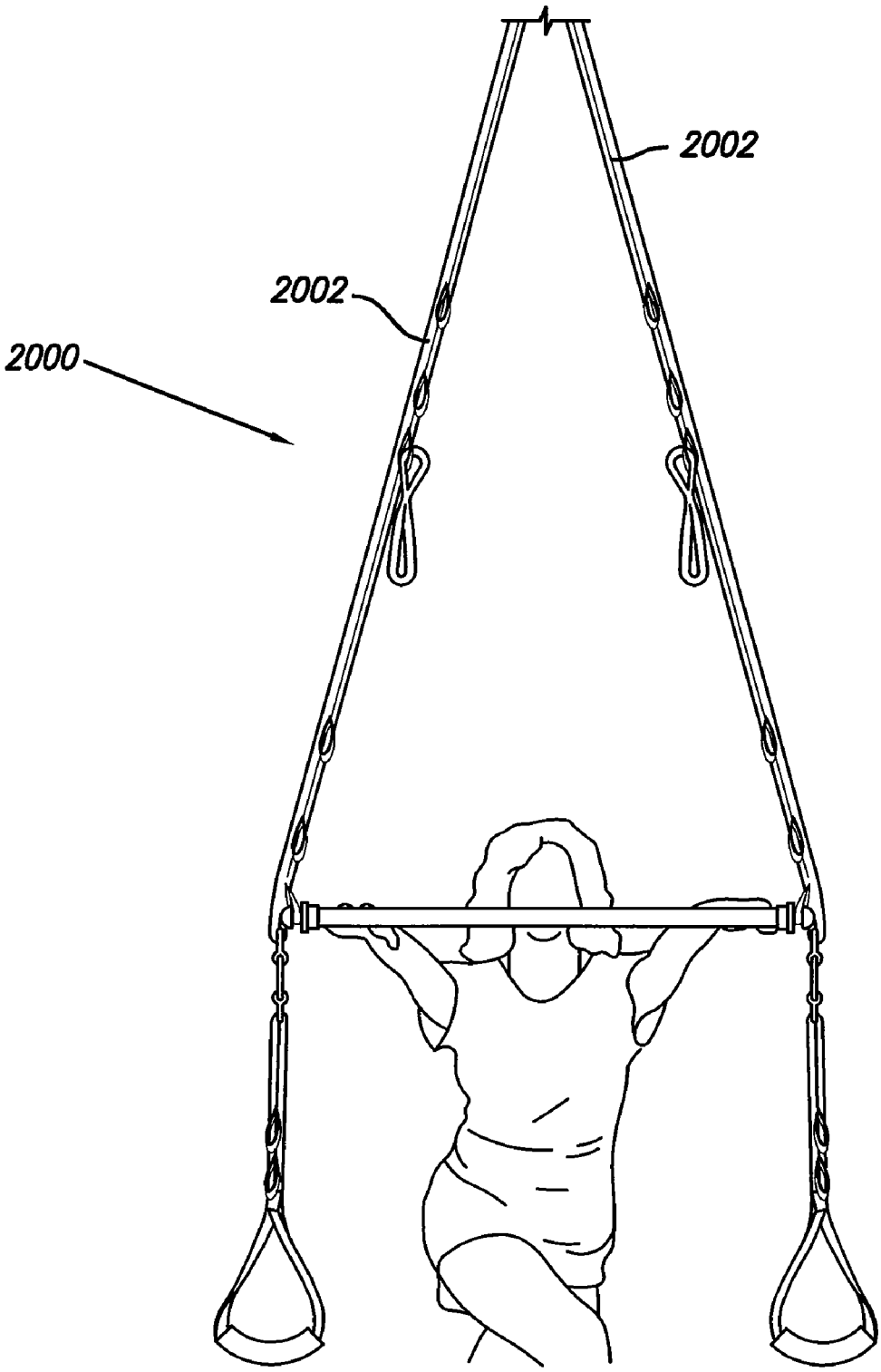
FIG. 20 is another exemplary embodiment of an exercise apparatus according to the present invention.
Figure 21:
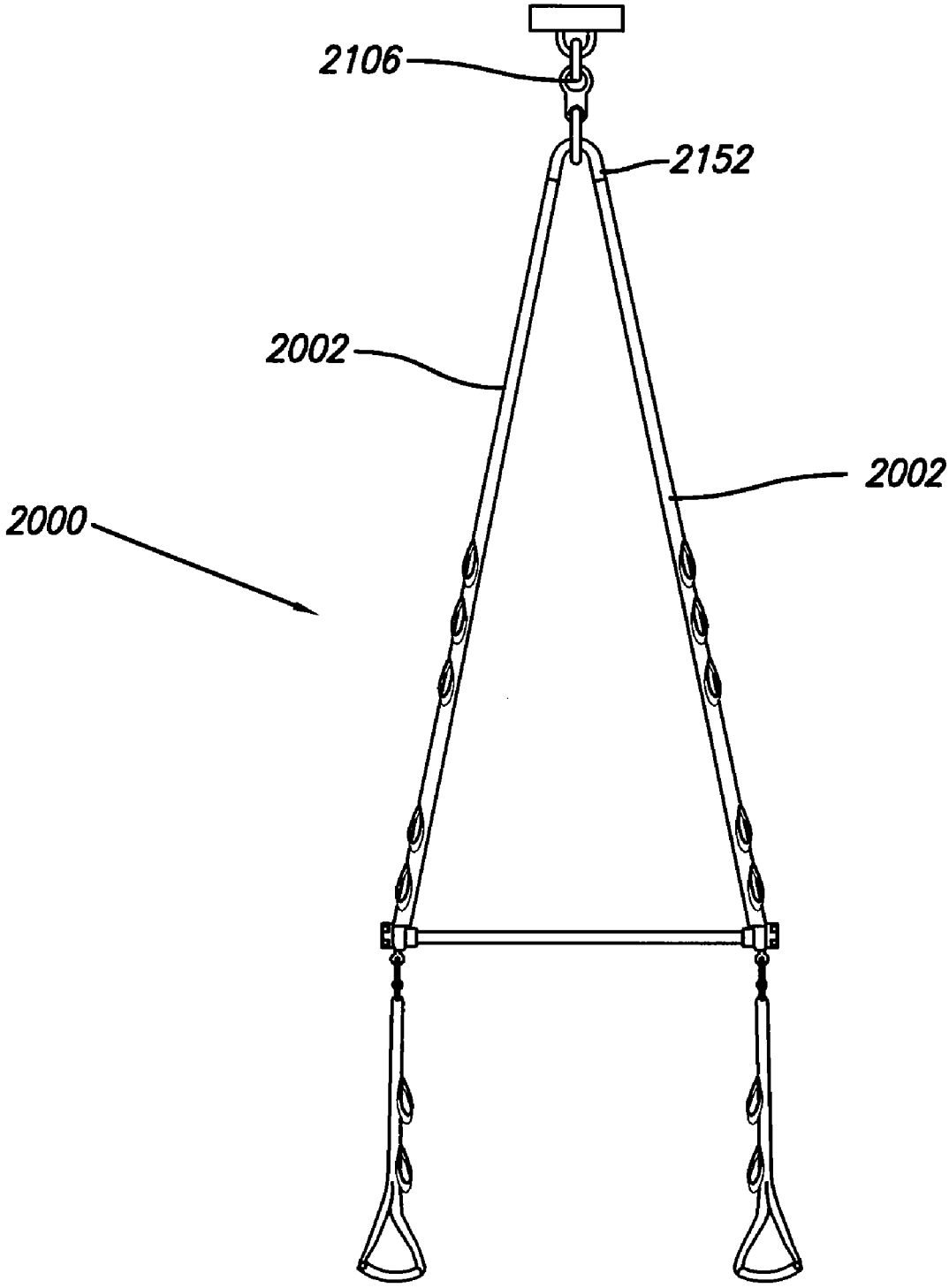
FIG. 21 is the exemplary exercise apparatus of FIG. 20 attached to an exemplary rotation mechanism.

In one embodiment, as shown in FIGS. 20-21, the exercise apparatus 2000 has a single main elongated member 2002 with a middle portion 2152 connected to the rotation mechanism 2106. Middle portion 2152 may be covered with a slip resistant material so that elongated member 2002 has equal lengths on either side of the connection point to rotation mechanism 2106. Alternatively, single main elongated member 2002 may be joined or tied at or near middle portion 2152 to the connection point to rotation mechanism 2106.

Figure 22:
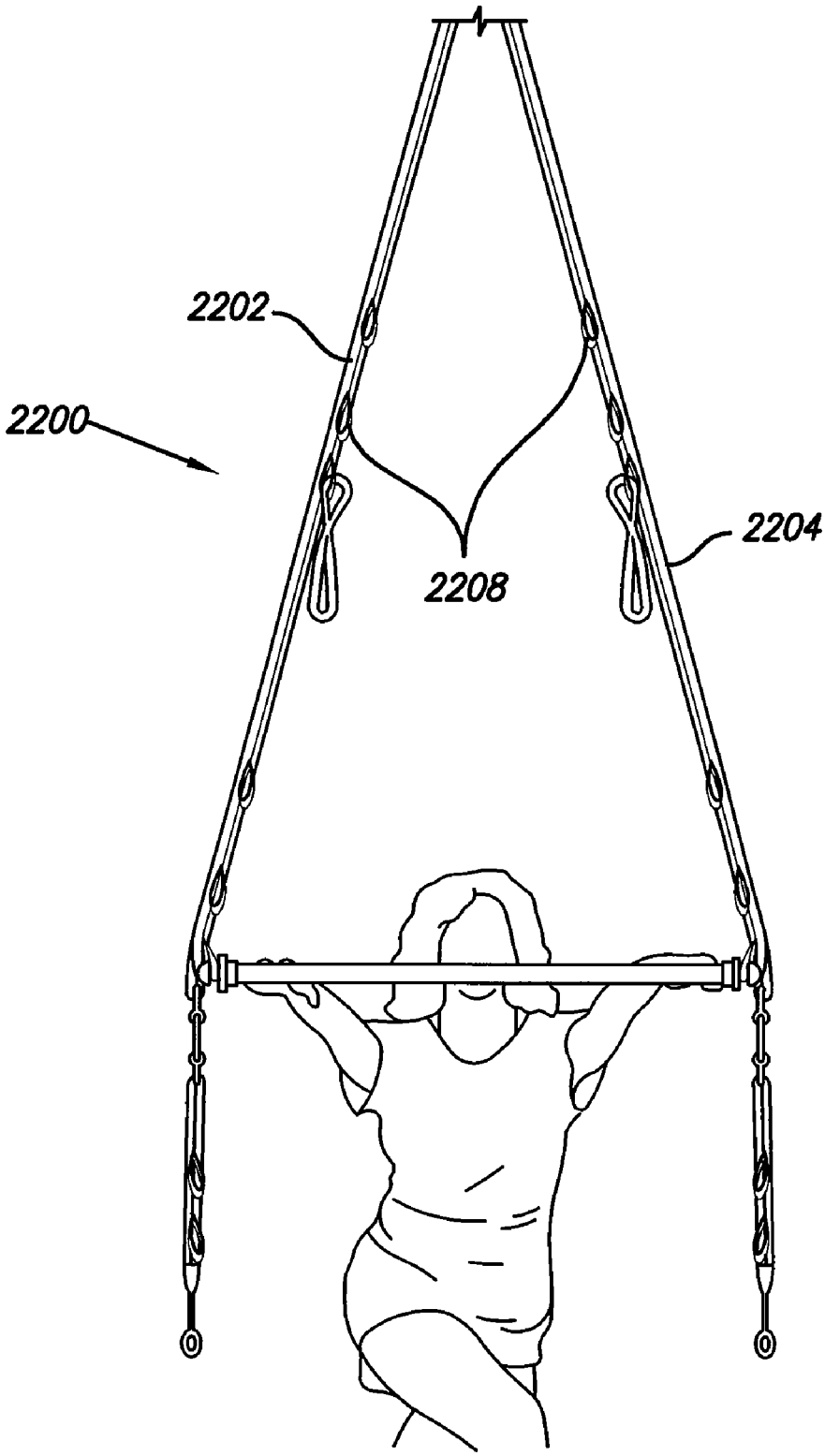
FIG. 22 is another exemplary embodiment of an exercise apparatus according to the present invention.
Figure 23:
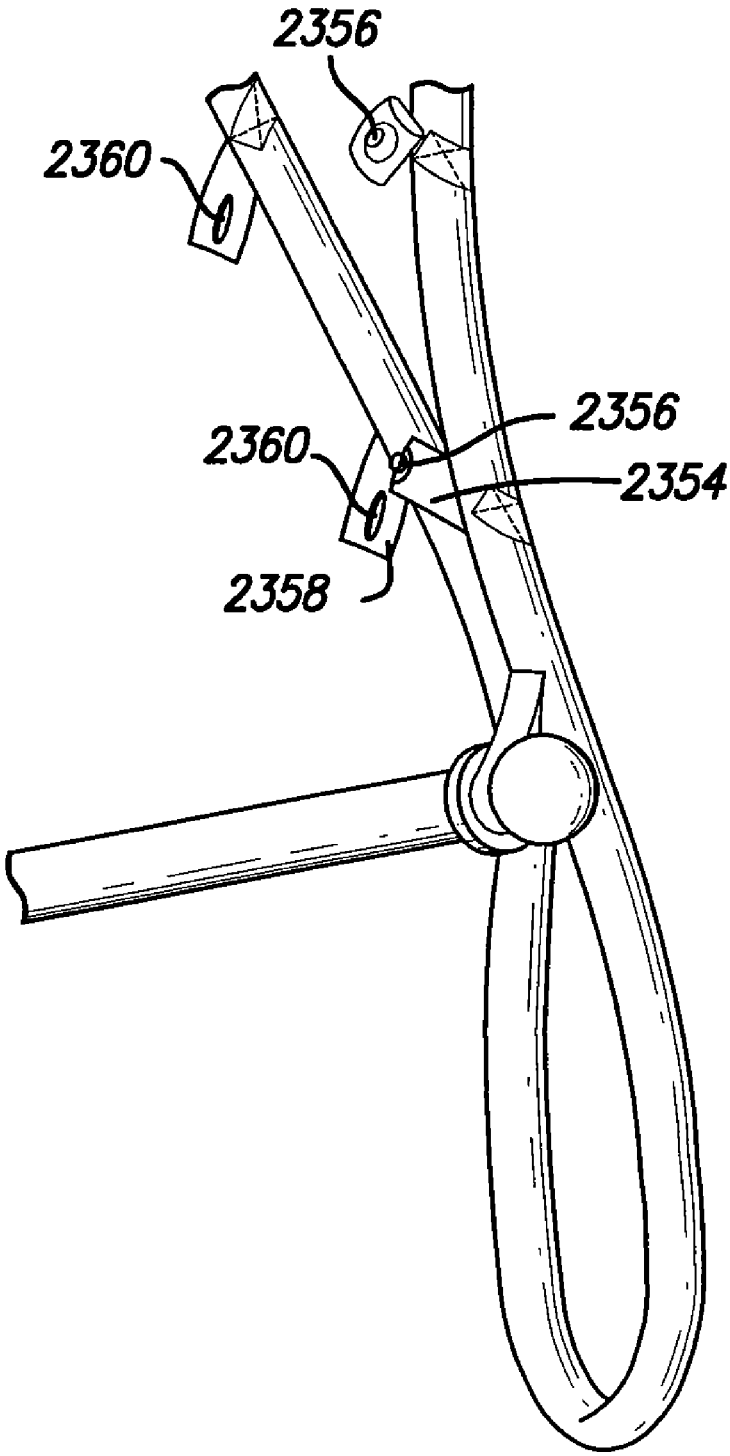
FIG. 23 is a close up thereof.
Figure 24:
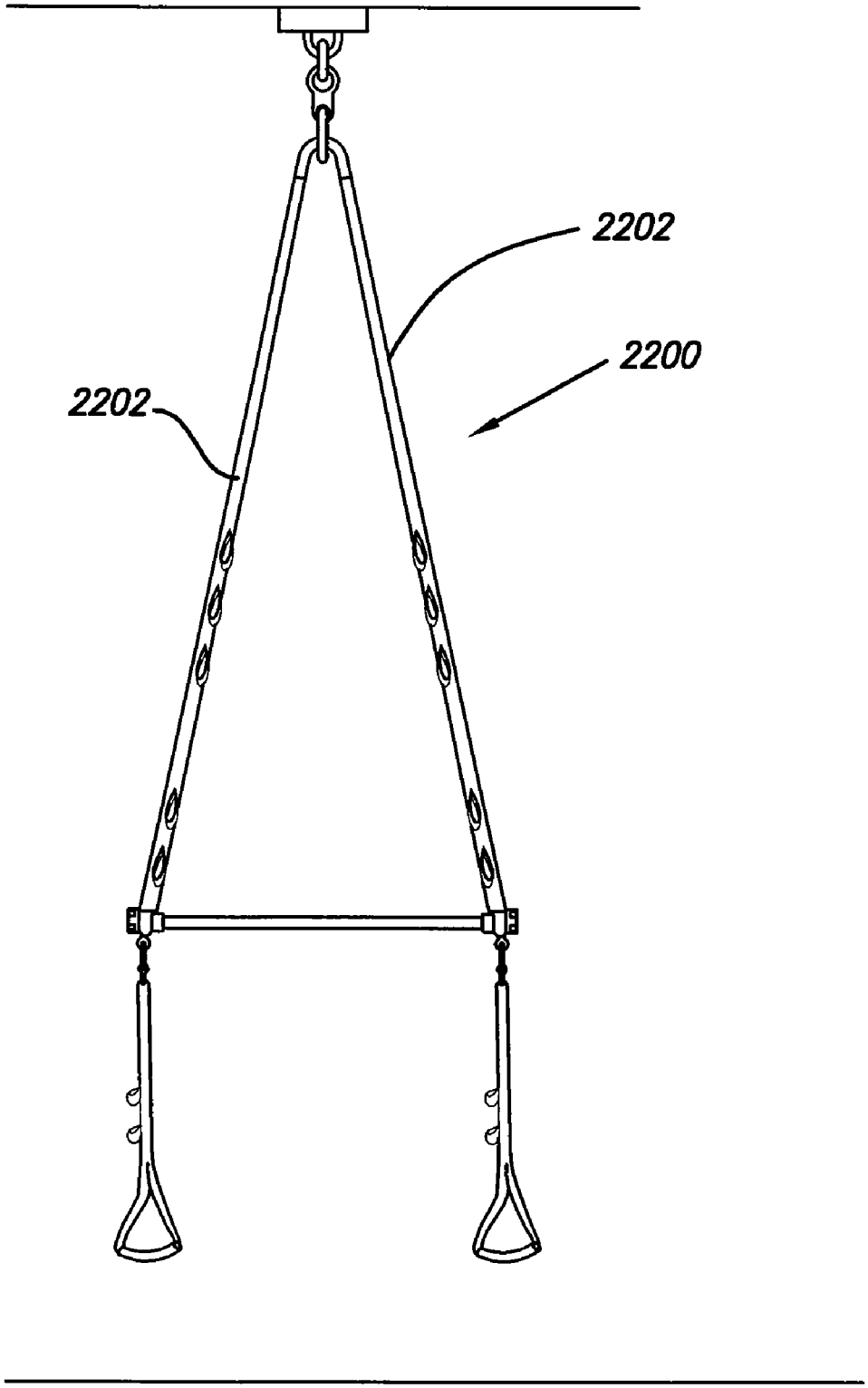
FIG. 24 is the exemplary exercise apparatus of FIG. 22 attached to an exemplary rotation mechanism.

In another embodiment, as shown in FIGS. 22-24, the exercise apparatus 2200 has elongated members 2202, 2204 that can be raised and pinned. An elongated member 2202, 2204 may have one or more first straps 2354 with a pin 2356 and one or more second straps 2358 with a slot 2360. First and second straps 2354, 2358 are spaced such that when an elongated member 2202, 2204 are raised upon itself first strap 2354 aligns with a second strap 2358. Each loop 2208 may be formed by inserting pin 2356 of each first strap 2354 into slot 2360 of each corresponding second strap 2358.

Figure 25:
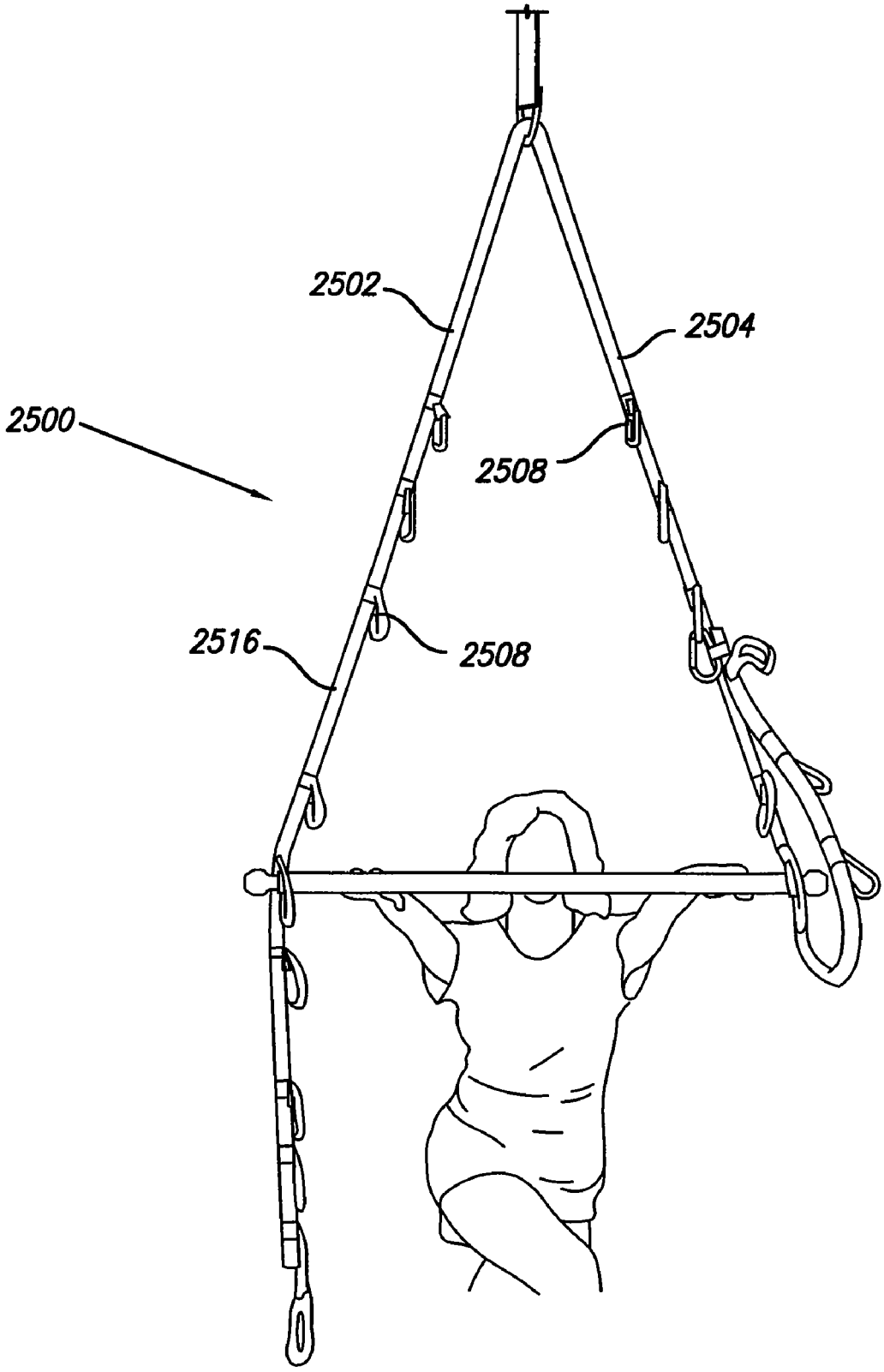
FIG. 25 is another exemplary embodiment of an exercise apparatus according to the present invention.
Figure 26:
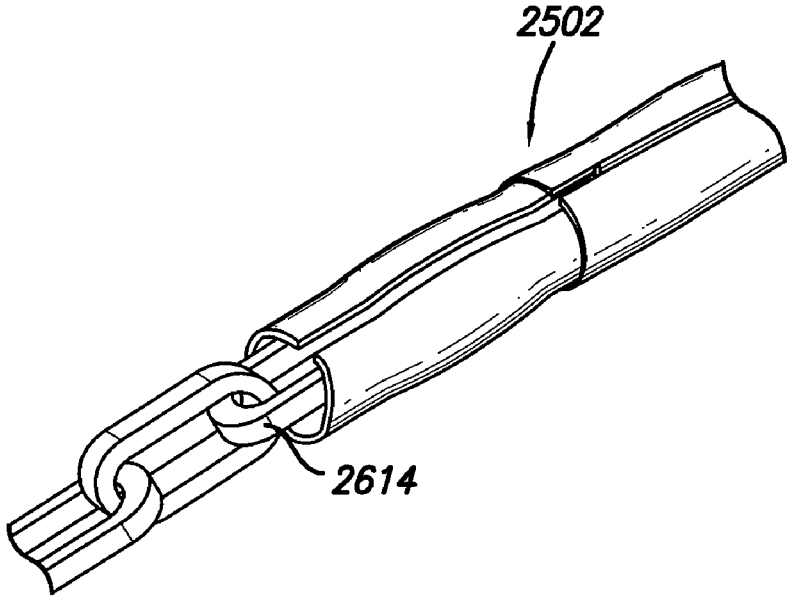
FIG. 26 is a close up thereof.

In another embodiment, as shown in FIGS. 25-26, an exercise apparatus 2500 may have elongated members 2502, 2504 with a chain link core 2614. Chain link core can provide a variety of locations to which attachment points can be easily anchored. Elongated members 2502, 2504 may be bendable to clip an end of an elongated member to an attachment point 2508 or to clip two attachment points of one or more elongated members together. In one such embodiment, the material for sheath 2516 should be pliable to allow such bending.

Figure 28:
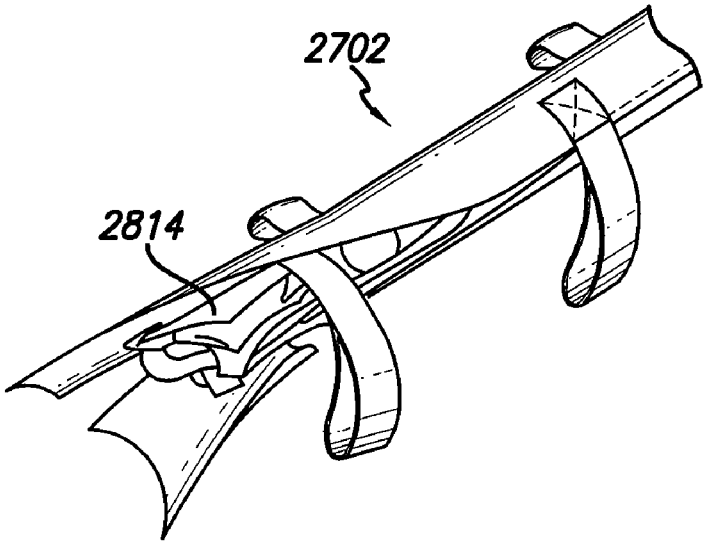
FIG. 28 is a close up thereof.
Figure 27:
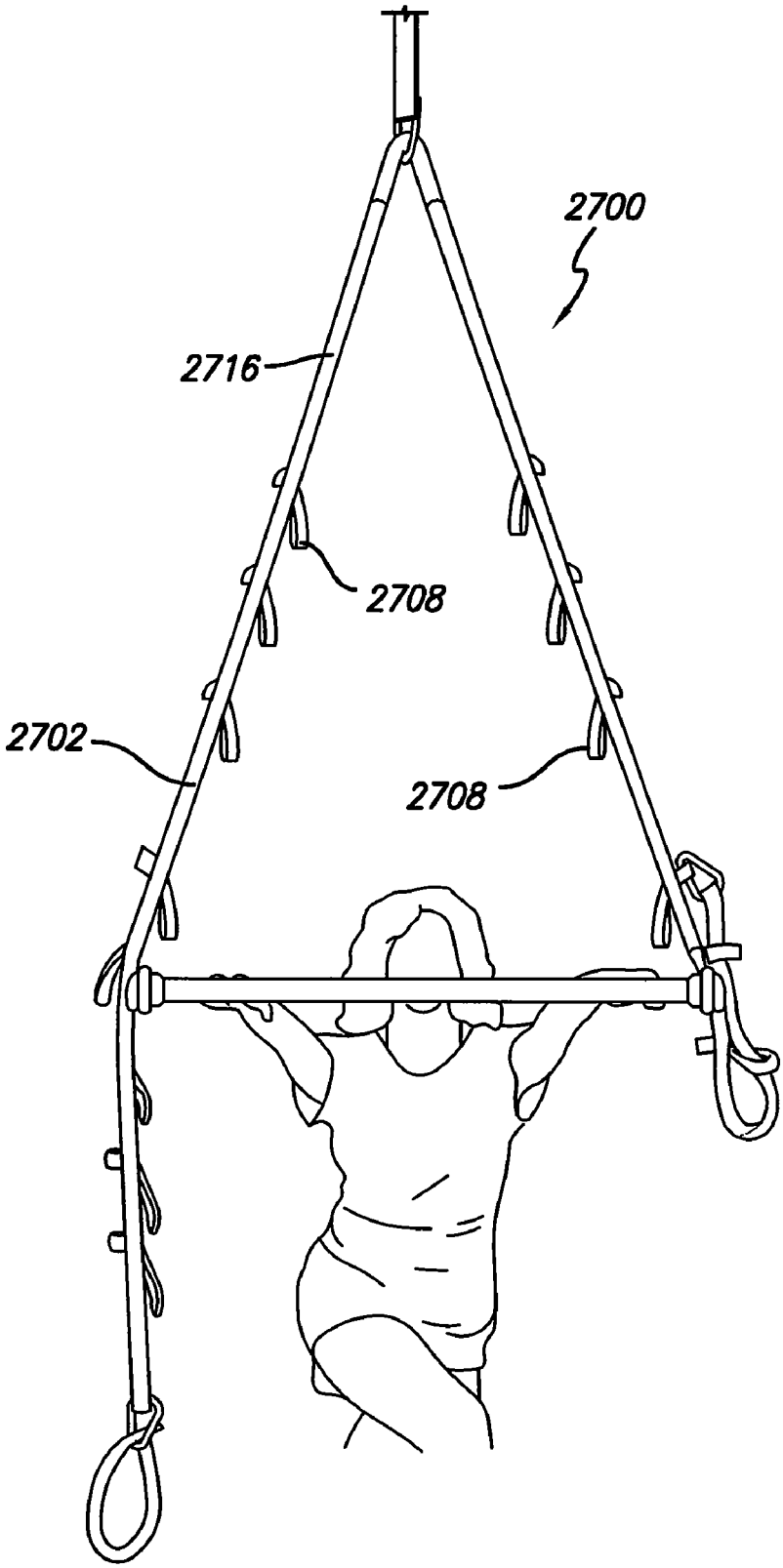
FIG. 27 is another exemplary embodiment of an exercise apparatus according to the present invention.

In another embodiment, as shown in FIGS. 27-28, an exercise apparatus 2700 may have elongated members 2702, 2704 with a core 2814 comprising stuffing such as, but not limited to, fiber, textile, rope, foam, rubber, and combinations thereof. Elongated members 2702, 2704 may be bendable to clip an end to an attachment point 2708 or to clip two attachment points of one or more elongated members together. In one such embodiment, the material for sheath 2716 should be pliable to allow such bending.

Figure 29:
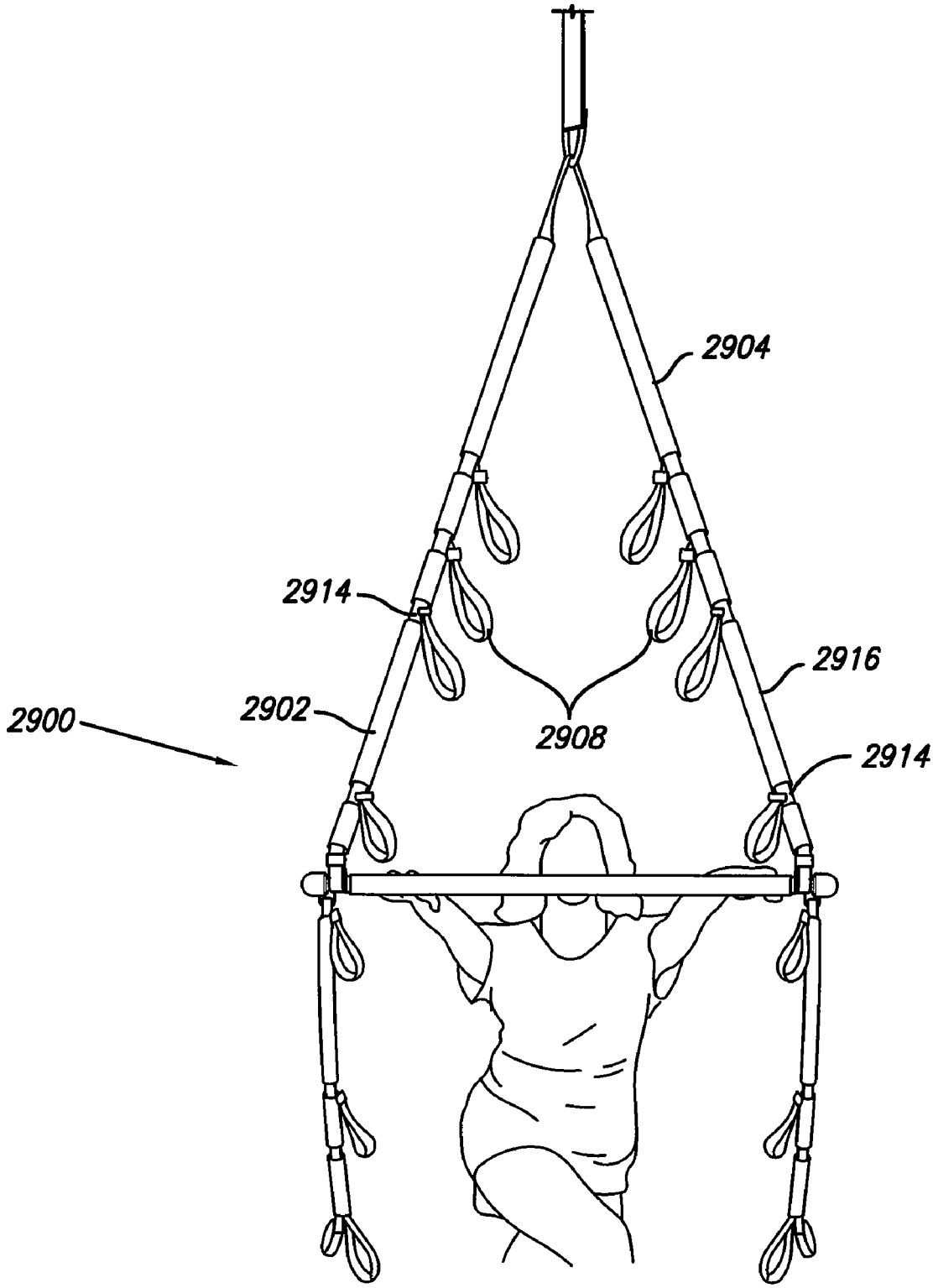
FIG. 29 is another exemplary embodiment of an exercise apparatus according to the present invention.
Figure 30:
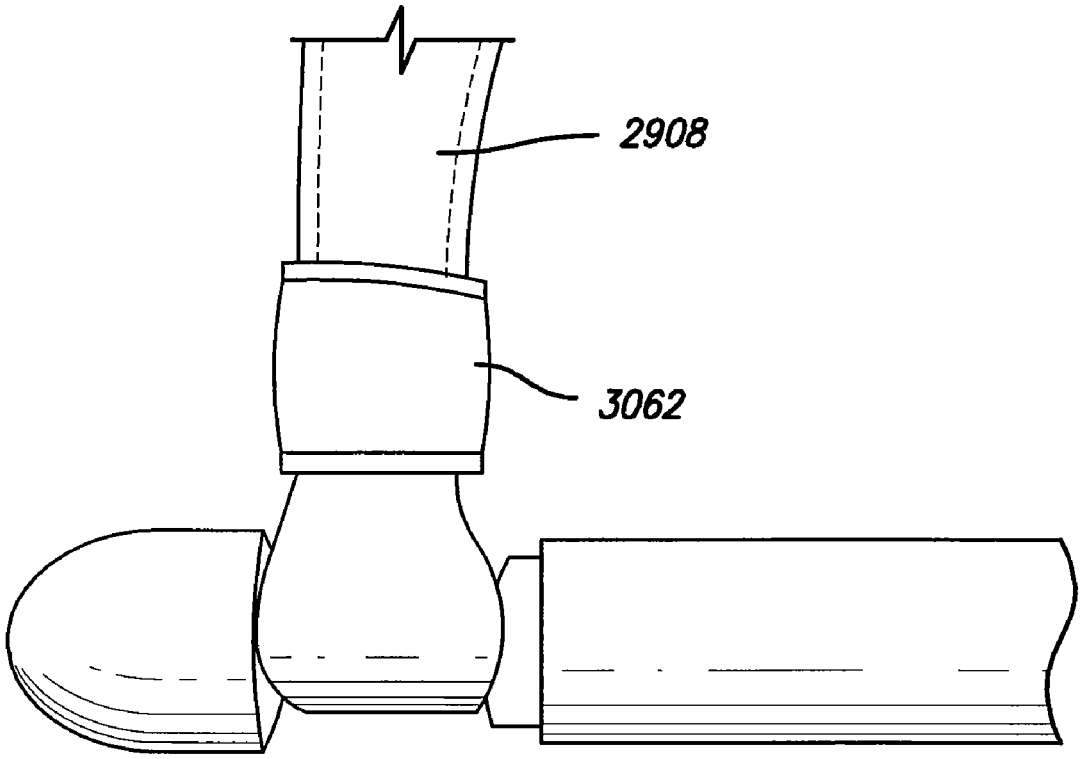
FIG. 30 is a close up view thereof.

In another embodiment, as shown in FIGS. 29-30, an exercise apparatus 2900 may have elongated members 2902, 2904 with a sheath 2916 of foam or rubber and a core 2914 (e.g., which includes fabric, strap, or webbing) that is exposed at each attachment point 2908. Attachment points 2908 may be loops and may have an adjustment member 3062 slidably attached to each loop to adjust the size of loop, for example to form a secure hold for a hand or foot. Adjustment member 3062 may be used to tighten the loop against a support such as bar 2928. Each elongated member 2902, 2904 may have a hook and loop type fastener 2964 for bending the elongated member to attach an end to one of the attachment points 2908. In such an embodiment, the materials for elongated members 2902, 2904 should be pliable to allow such bending.

Figure 31:
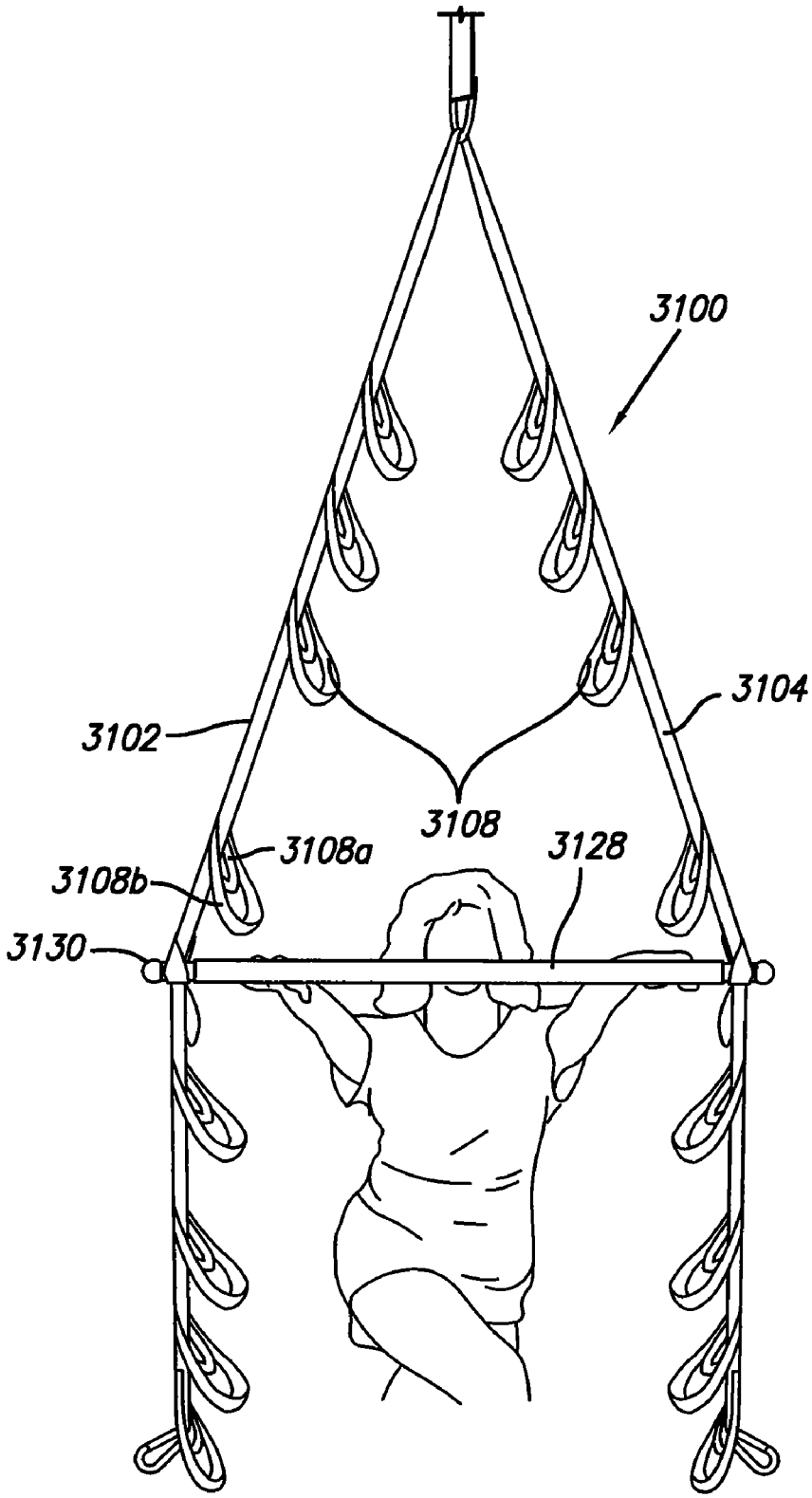
FIG. 31 is another exemplary embodiment of an exercise apparatus according to the present invention.
Figure 32:
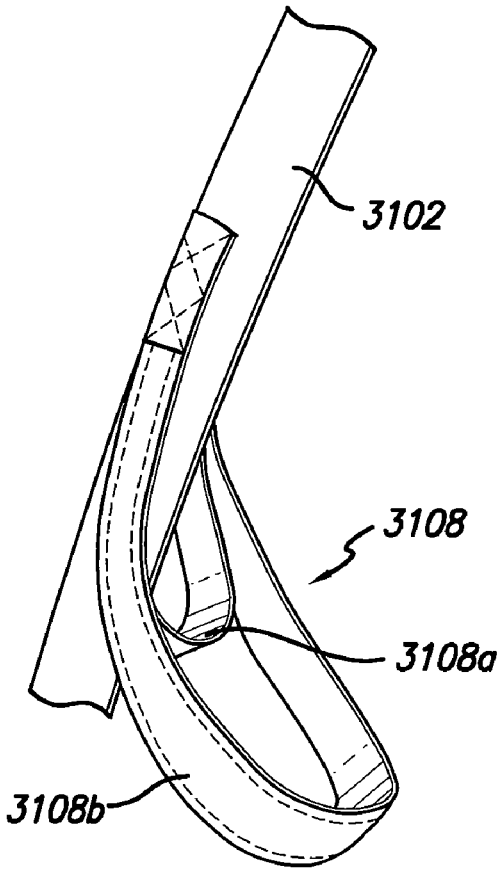
FIG. 32 is a close up view thereof.
Figure 33:
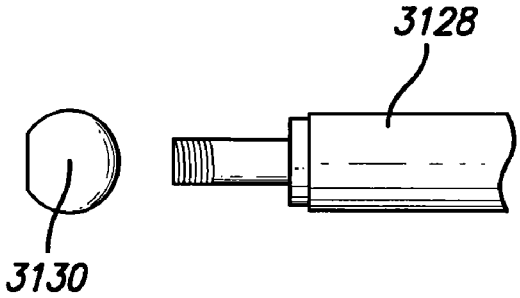
FIG. 33 is another close up view thereof showing an exemplary support of FIG. 31.
Figure 34:
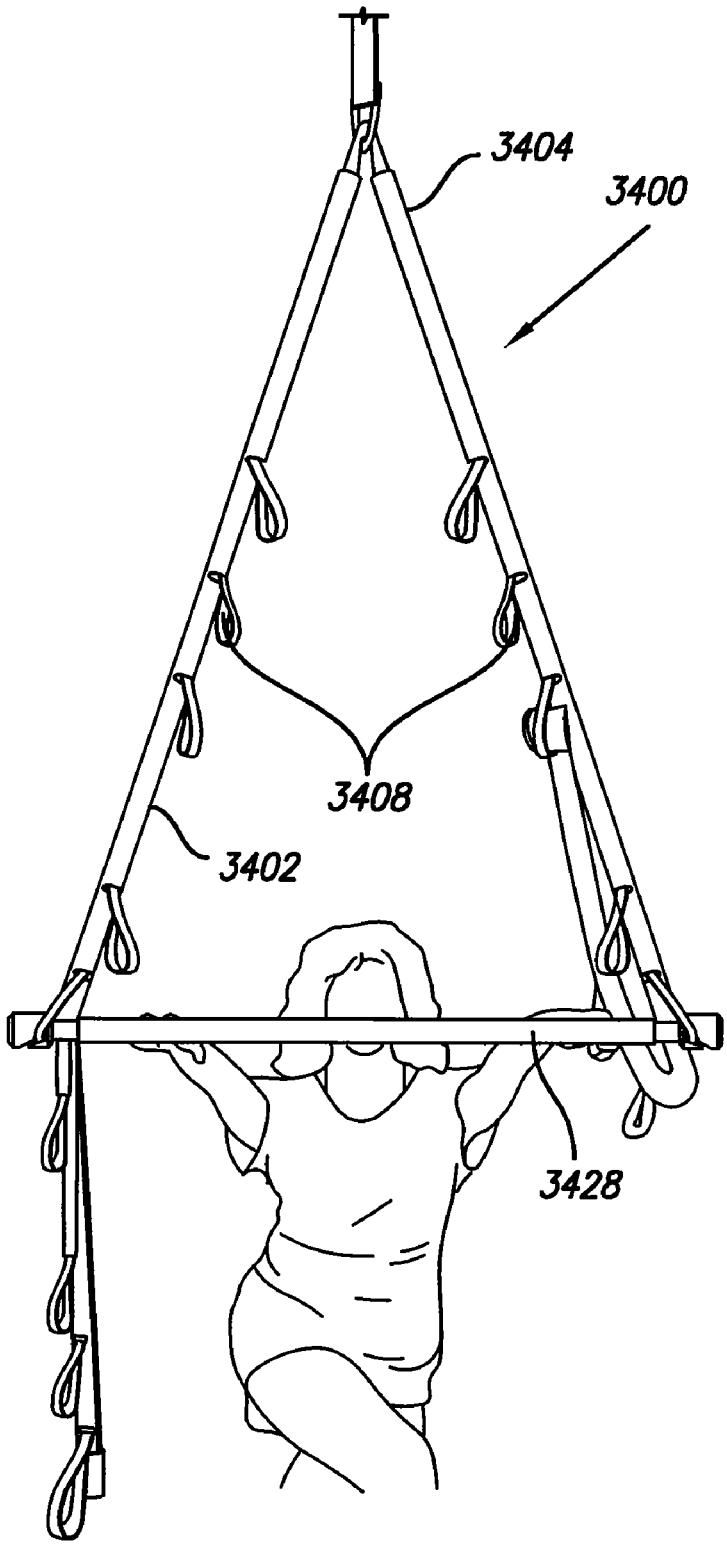
FIG. 34 is another exemplary embodiment of an exercise apparatus according to the present invention.
Figure 35:
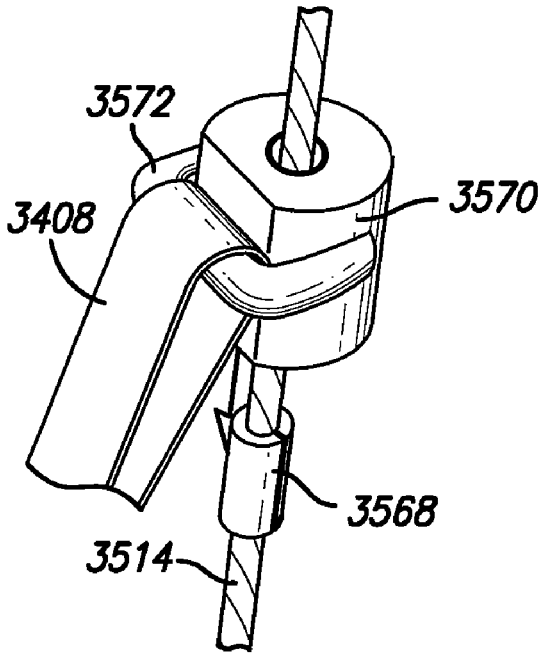
FIG. 35 is an exemplary attachment point of FIG. 34.

In another embodiment, as shown in FIGS. 31-33, an exercise apparatus 3100 may have elongated members 3102, 3104 wherein each attachment point 3108 comprises two loops, as best shown in FIG. 32. An inner loop 3108*a* can be used to secure a support to an elongated member and an outer loop 3108*b* can be used, for example, as a foot or hand hold. End caps 3130 of bar 3128 may be screwed onto bar 3128 as shown in FIG. 33. Each of elongated members 3102, 3104 may have a clip 3166 for bending the elongated member to attach an end to one of attachment points 3108. In such an embodiment, the material for elongated members 3102, 3104 should be pliable to allow such bending.

Figure 36:
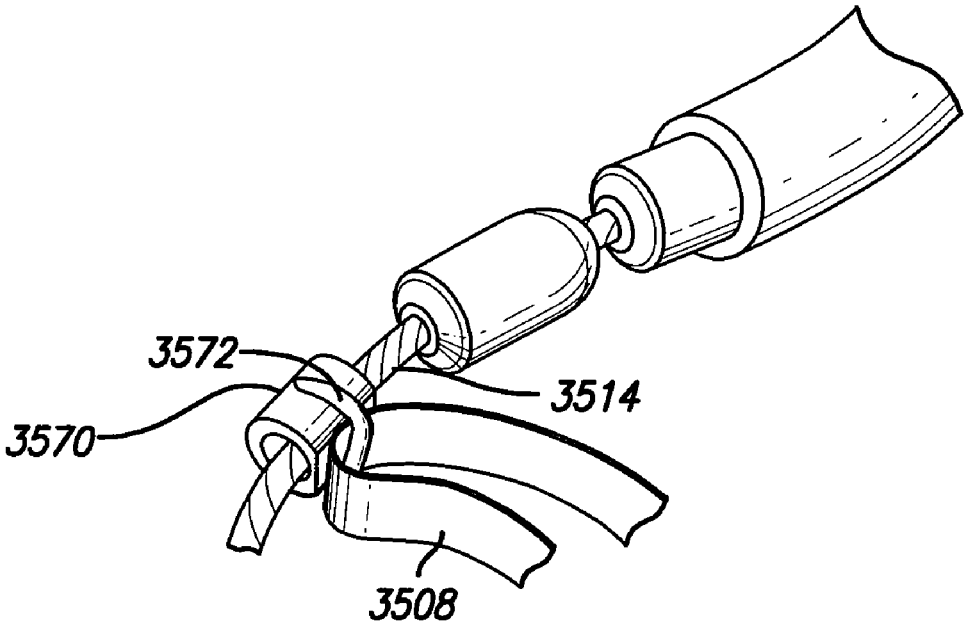
FIG. 36 is an exemplary core of the exemplary elongated member of FIG. 34.
Figure 37:
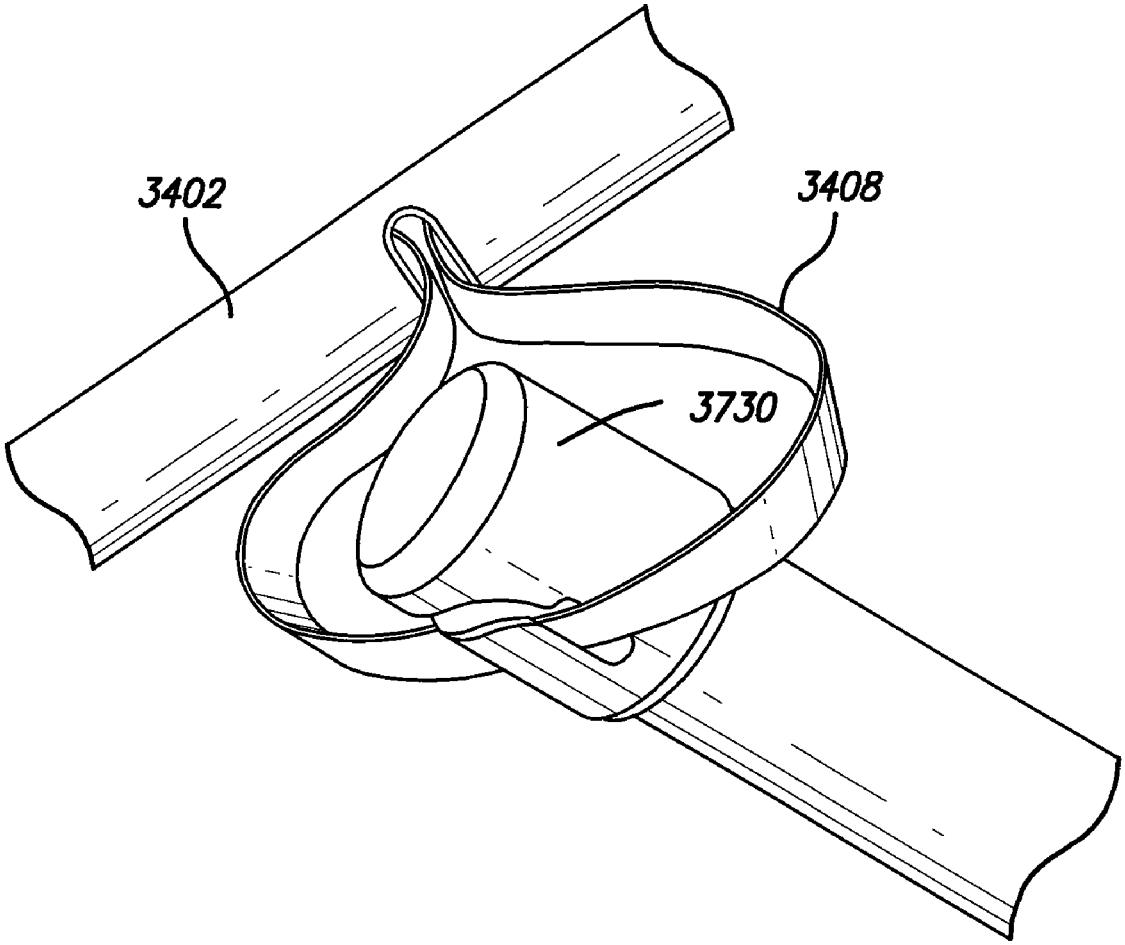
FIG. 37 is a close up view of an exemplary attachment point of FIG. 34 connected to an exemplary support of FIG. 34.
Figure 38:
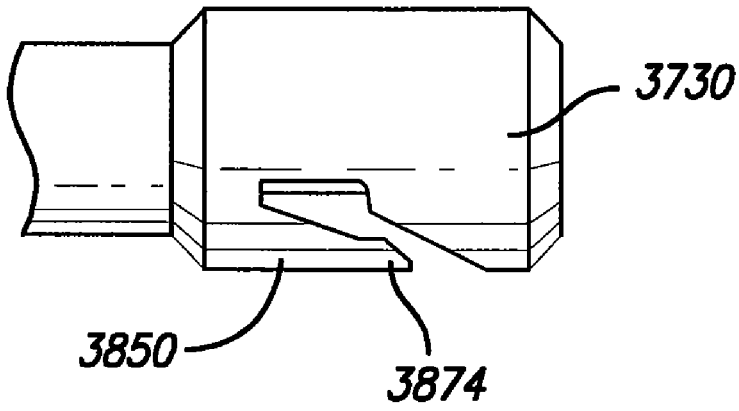
FIG. 38 is an exemplary end cap of an exemplary support of FIG. 34.
Figure 39:
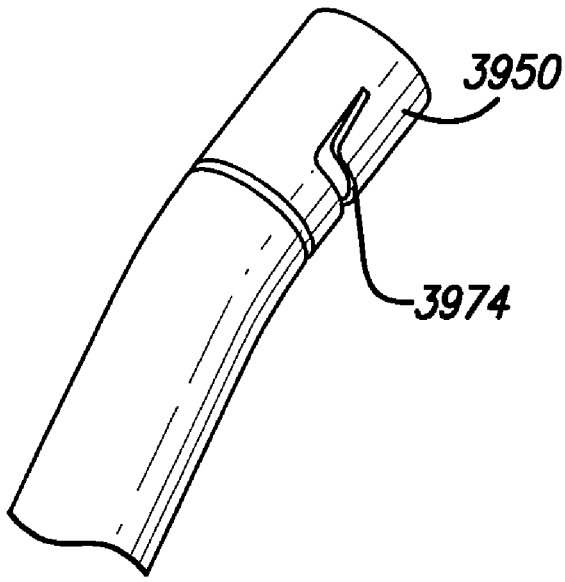
FIG. 39 is an exemplary end cap of an exemplary elongated member of FIG. 34.

In another embodiment, as shown in FIGS. 34-39, the exercise apparatus 3400 may have elongated members 3402, 3404 wherein the core 3514 may be a metal cable with one or more swaged areas 3568. A slidable jacket 3570 may slide over the swaged area 3568 to maintain its position along core 3514. Each slidable jacket 3570 may have a handle or ring 3572 through which the loop 3408 is attached. Spaces between slidable jackets 3570 on core 3514 may be covered with rubber to achieve a uniform thickness, as shown in FIG. 36. End caps 3730 may have a clip 3850 that receives loop 3408 and a portion of clip 3850 may have a hook 3874 that catches loop 3408 and prevents bar 3428 from rotating. The end of the elongated members 3402, 3404 may also have an end cap 3930 with a clip 3950 and hook 3974 for bending the elongated member to attach an end to one of loops 3408. In such an embodiment, the material for elongated members 3402, 3404 should be pliable to allow such bending.

Figure 40:
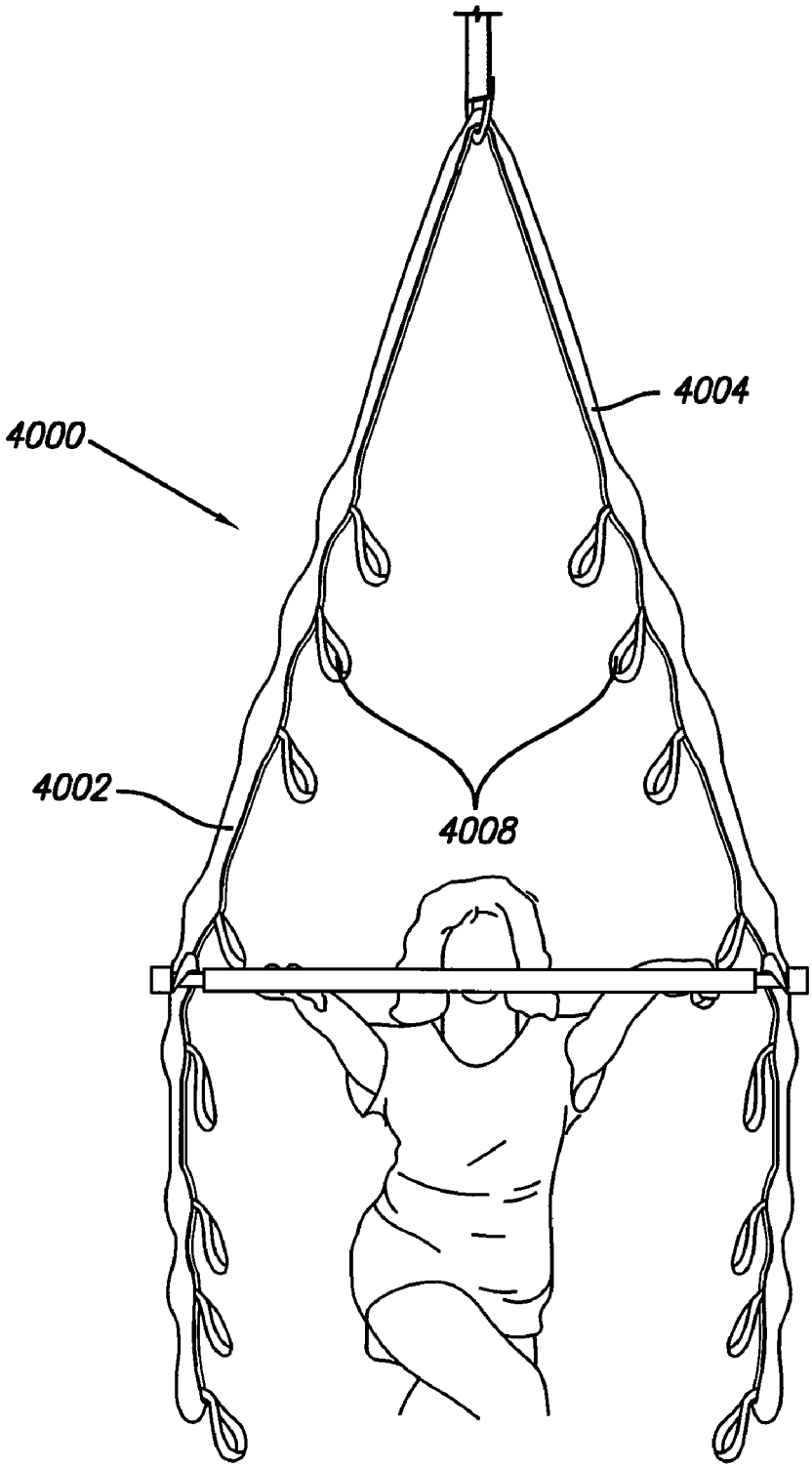
FIG. 40 is another exemplary embodiment of an exercise apparatus according to the present invention.
Figure 41:
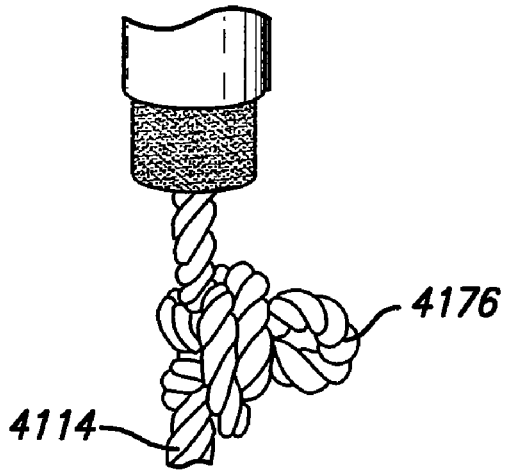
FIG. 41 is an exemplary core of the exemplary elongated member of FIG. 40.
Figure 42:
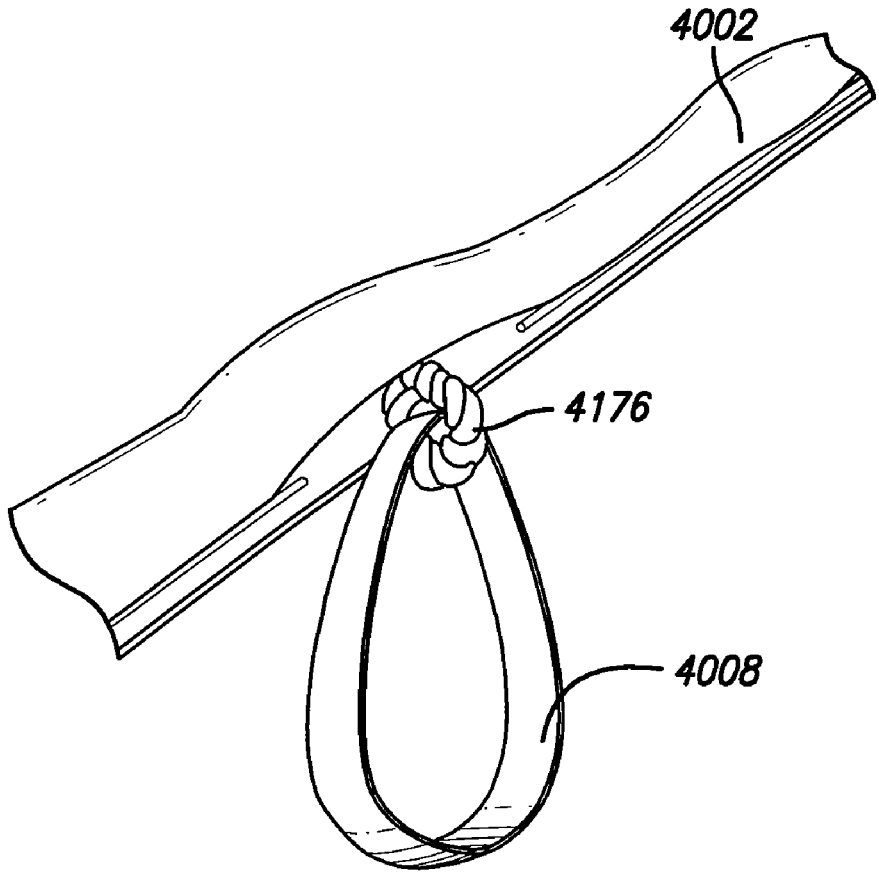
FIG. 42 is an exemplary attachment point of FIG. 40.

In another embodiment, as shown in FIGS. 40-42, an exercise apparatus 4000 may have elongated members 4002, 4004 wherein core 4114 may include a rope covered with a padding or filler such as, for example, foam padding. There may be breaks in the padding or filler for knots 4176 (e.g., butterfly knots) tied in the rope to be exposed for connecting the attachment points 4008, such as a loop or strap, as best shown in FIGS. 41-42.

Figure 43:
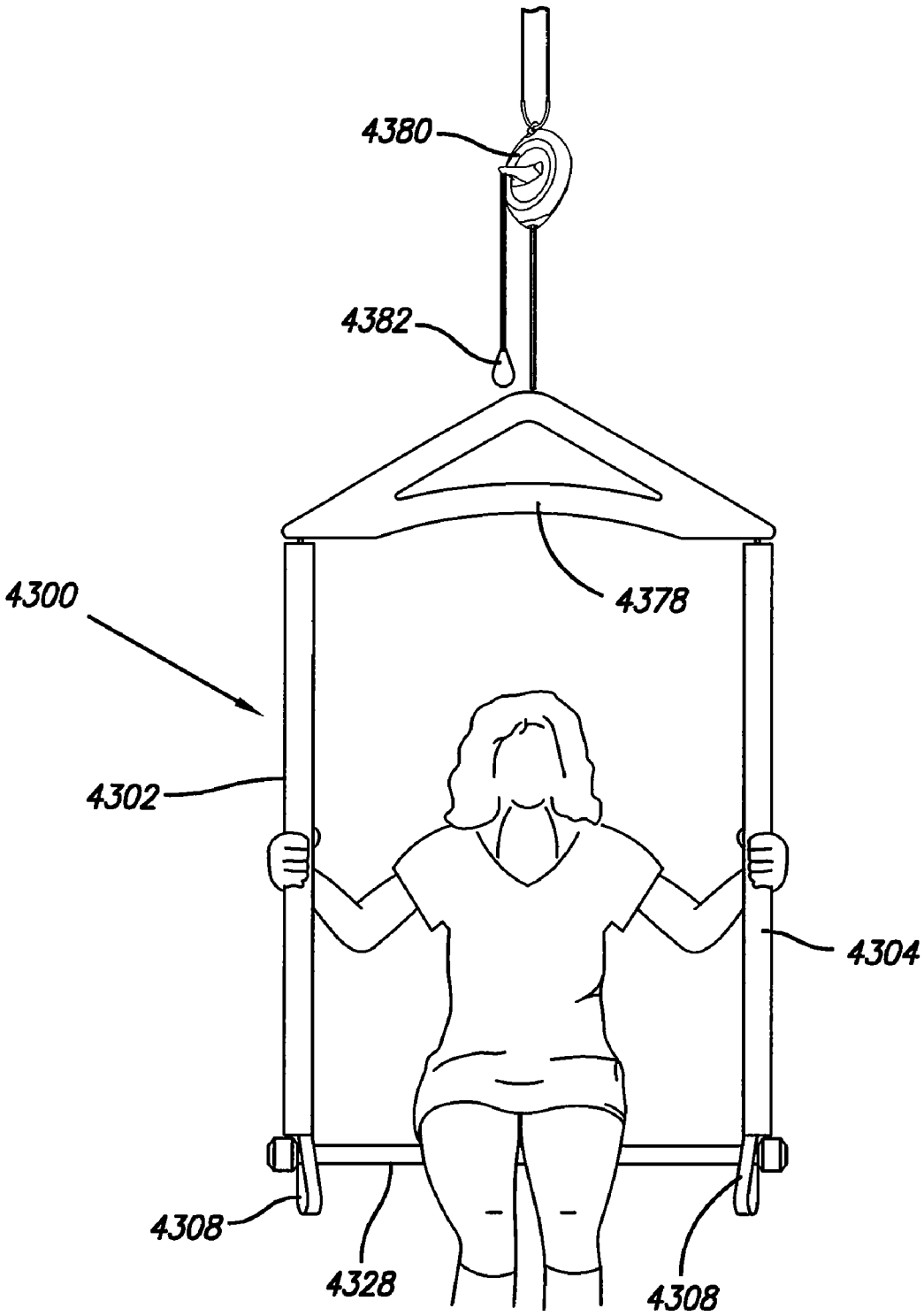
FIG. 43 is another exemplary embodiment of an exercise apparatus according to the present invention.

In another embodiment, as shown in FIG. 43, an exercise apparatus 4300 may have elongated members 4302, 4304 with a bar 4328 attached to a loop 4308 at one end. The other end of each elongated members 4302, 4304 is attached to a hanging frame 4378 which is attached to cord coiled around a pulley 4380. A pull string 4382 is attached to pulley 4380 that is pulled to allow adjustment for the height of exercise apparatus 4300 from the ground, thereby making exercise apparatus 4300 configurable for users of different height or for performing exercises on different areas of the user's body. Such an apparatus may also include additional attachment points along elongated members 4302, 4304 for connecting hand or foot holds, additional support members, or elongated extension members.

Figure 44:
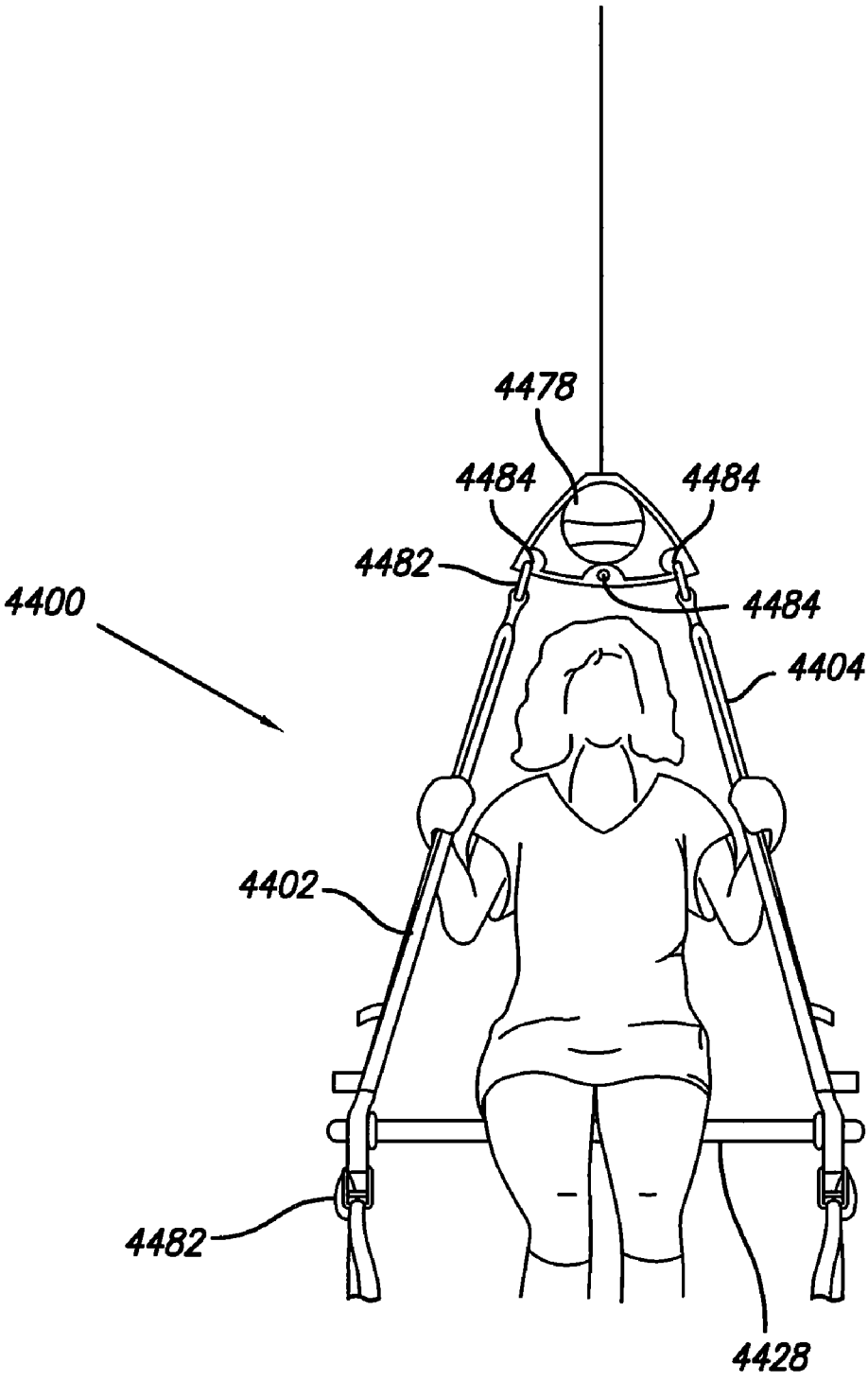
FIG. 44 is another exemplary embodiment of an exercise apparatus according to the present invention.
Figure 45:
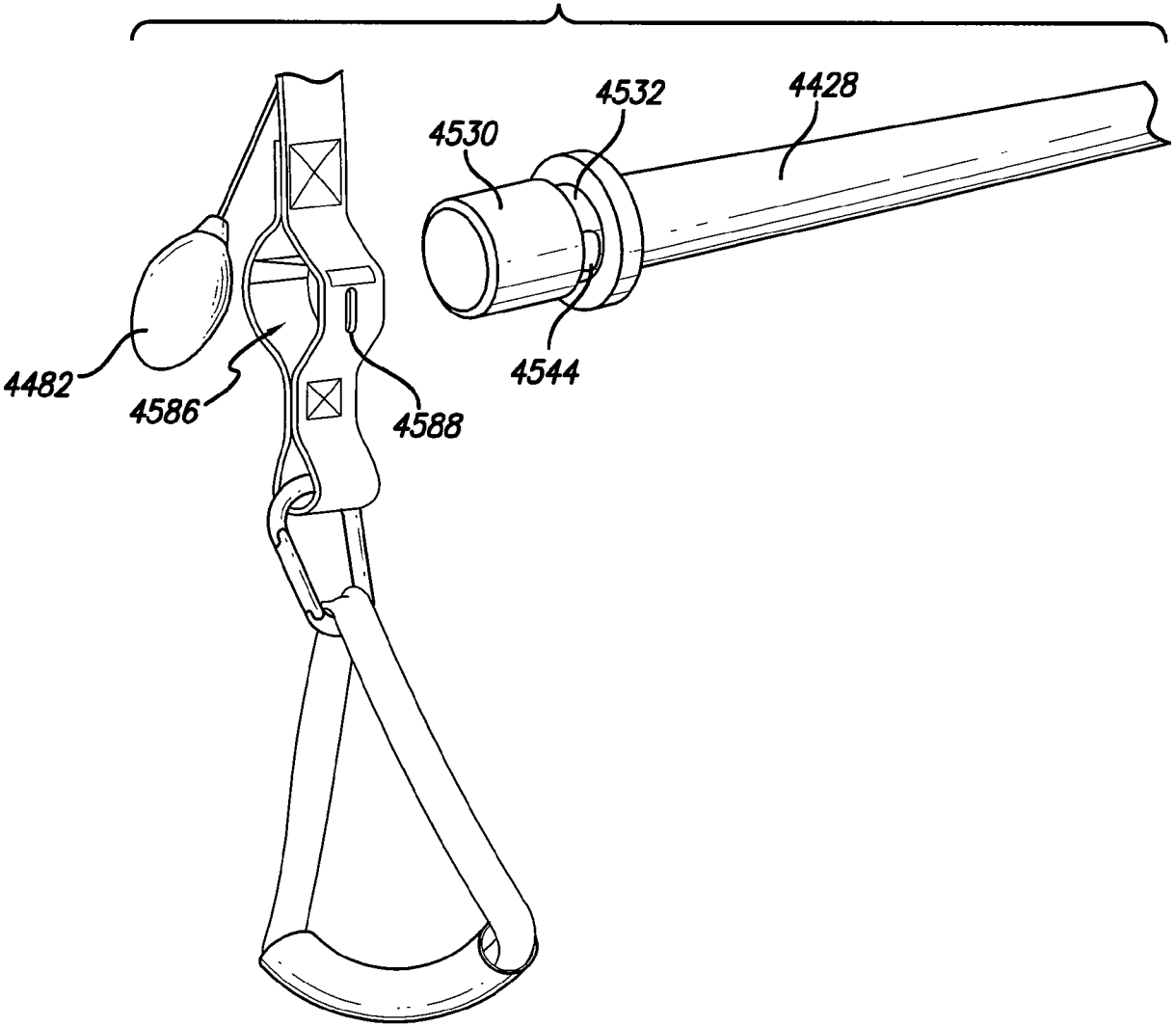
FIG. 45 is a close up view of an exemplary attachment point of FIG. 44 before being connected to an exemplary support of FIG. 44.
Figure 46:
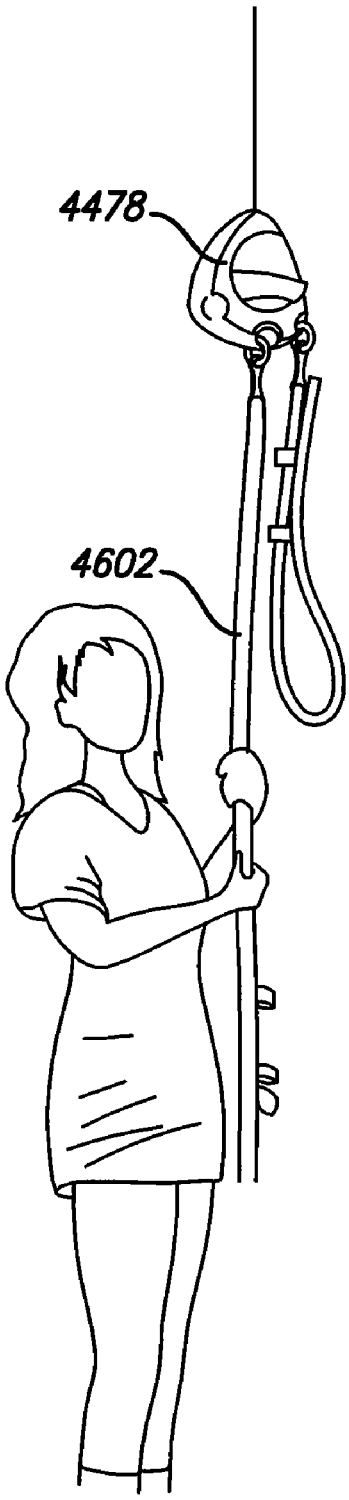
FIG. 46 is another view of the exercise apparatus of FIG. 44 with a single elongated member.
Figure 47:
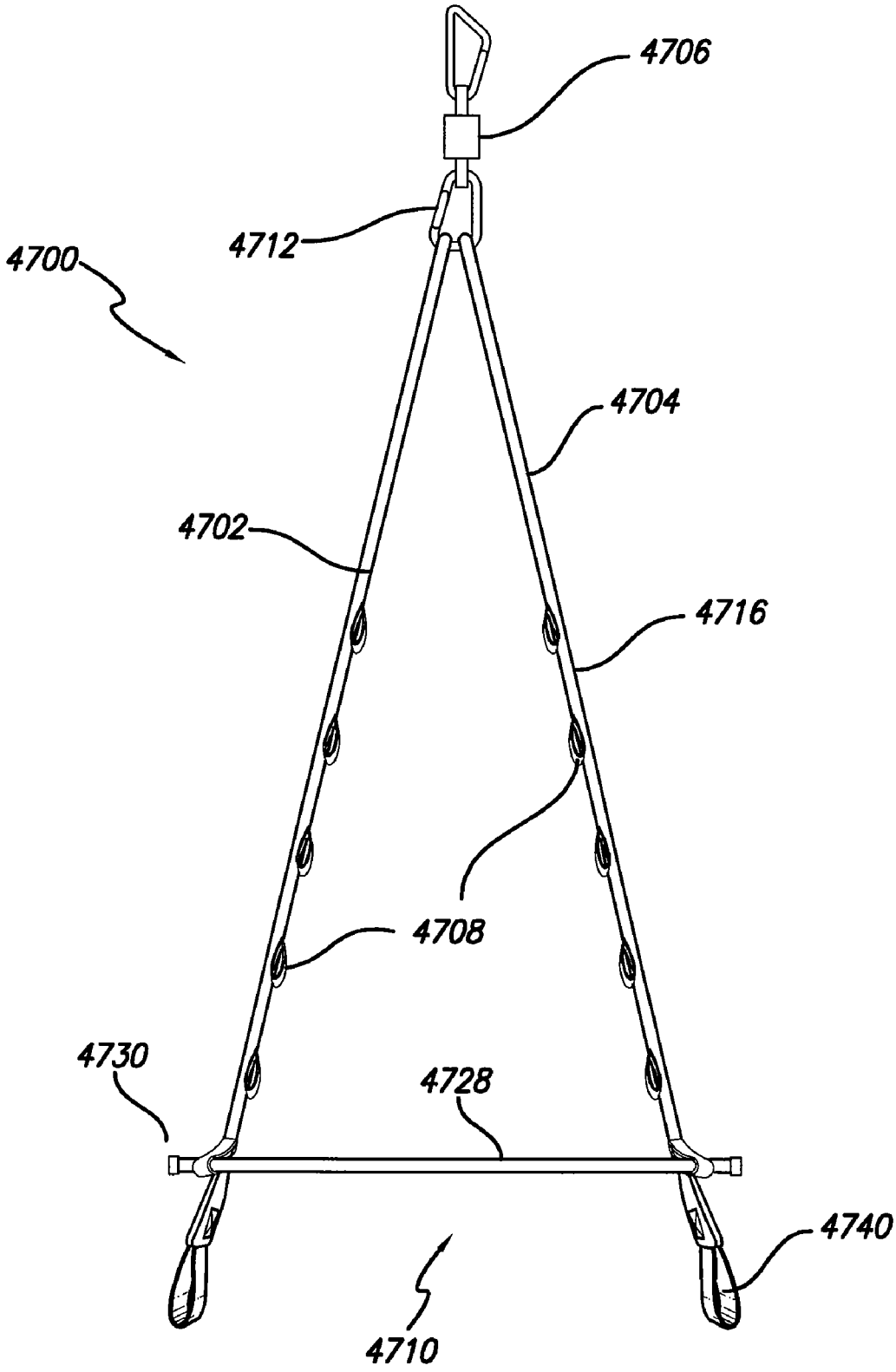
FIG. 47 is another exemplary embodiment of an exercise apparatus according to the present invention.

In another embodiment as shown in FIGS. 44-46, the exercise apparatus 4400 may have elongated members 4402, 4404. One end of each of elongated members 4402, 4404 is attached to a hanging frame 4478 which has a cord coiled inside. Hanging frame 4478 has a hole 4484 for each elongated member 4402, 4404 to be attached thereto. A pull string 4482 is attached to hanging frame 4478 that is pulled to allow adjustment for the height of exercise apparatus 4400 from the ground, thereby making exercise apparatus 4400 configurable for users of different height or for performing exercises on different areas of the user's body. As shown in FIG. 45, the other end of each elongated member 4402, 4404 may be folded over on itself to form an opening 4586 for receiving an end cap 4530 of bar 4428. End cap 4530 has a protrusion 4544 extending outward from a channel 4532 in end cap 4530. Protrusion 4544 fits into a slot 4588 in elongated member 4402, 4404 formed in the region of opening 4586 to hold bar 4428 in place and prevent it from rotating. As best seen in FIG. 46, a single elongated member 4602 may be attached to hanging frame 4478.

In one embodiment, as shown in FIGS. 47-53, the exercise apparatus includes a first vertical support or elongated member 4702 and a second vertical support or elongated member 4704 joined to a connector 4712, which in one embodiment is a delta carabiner, which is connected to a swivel or rotation mechanism 4706. Rotation mechanism 4706 may be suspended from the ceiling, wall, or other support so that exercise apparatus 4700 is suspended above the floor or other surface on which a user will stand to use the apparatus. First and second elongated members 4702, 4704 each have one or more attachment points or loops 4708 to which a variety of exercise devices may be removably connected to apparatus 4700. One example of such an exercise device is bar or support 4710. Support 4710 may include a gripping material.

Figure 48:
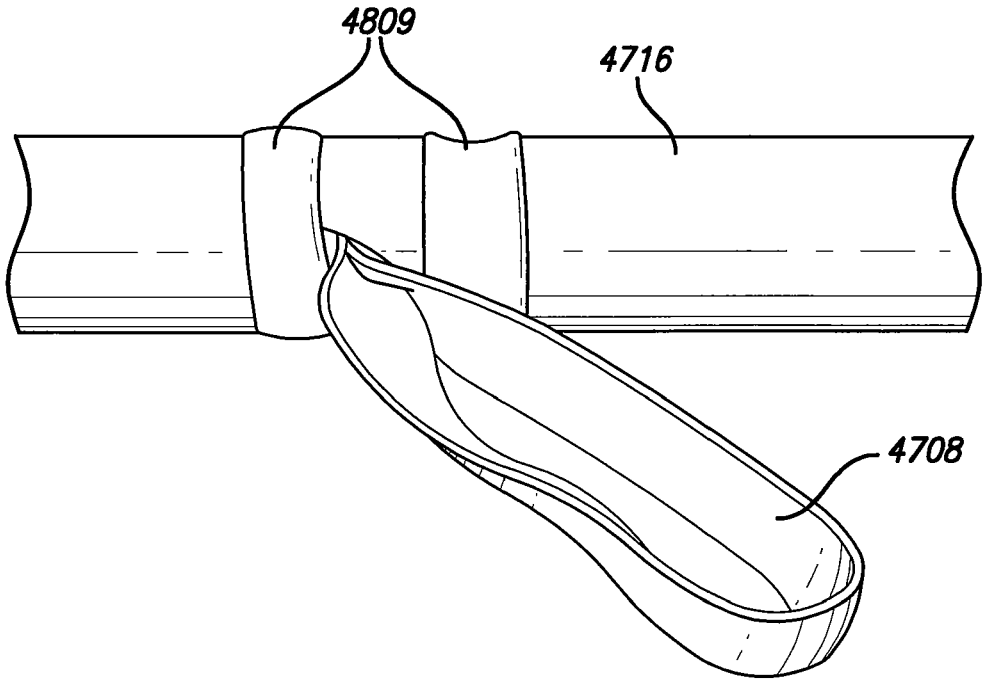
FIG. 48 is a close up view of an exemplary attachment point of FIG. 47.

As best seen in FIG. 48, first and second elongated members 4702, 4704 may have a twisted rope sheath 4716 and webbing may form the core of sheath 4716 and may extend outwardly from sheath 4716 as loops 4708. The number of loops 4708 may vary. In one embodiment, each elongated member includes at least two loops 4708 Sheath 4716 may have a wrap 4809 above and below each loop 4708 to prevent twisted rope sheath 4716 from unraveling as a result of loops 4708 extending outwardly from sheath 4716. The material for wrap 4809 may be the same material as loops 4708. Alternatively, wrap 4809 may include a wire, tape, or surface treatment to twisted rope sheath 4716. In some embodiments, a rope sheath such as a synthetic rope sheath can be melted or fused in such locations to prevent unraveling.

Figure 49:
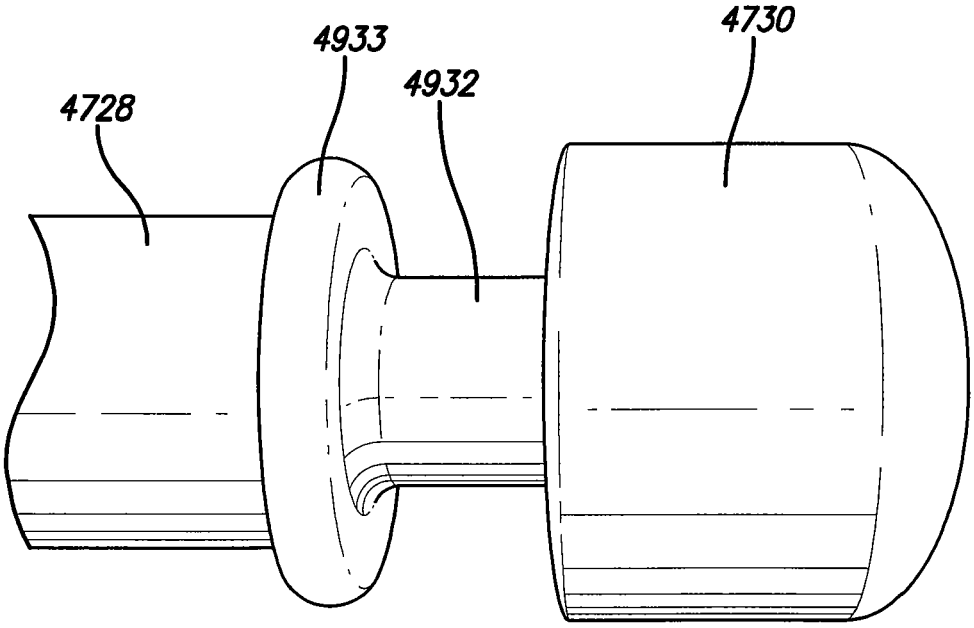
FIG. 49 is close up view of showing an exemplary end cap of an exemplary support of FIG. 47.
Figure 50:
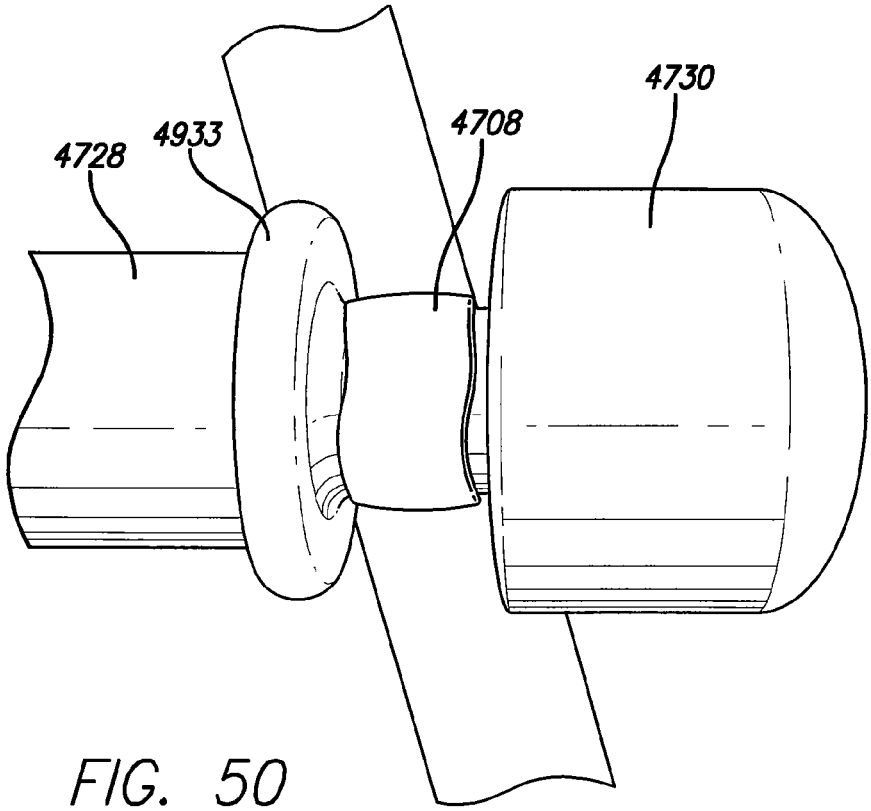
FIG. 50 is close up view showing the connection of the exemplary support of FIG. 49 to the exemplary attachment point of FIG. 48.

As best seen in FIGS. 49-50, support 4710 may include a bar 4728 with end caps 4730 on either end that are attached to loops 4708 on first and second elongated members 4702, 4704. Each end cap 4730 may have a narrow portion or channel 4932 for receiving loops 4708 and a flange 4933 between bar 4728 and channel 4932. Channel 4932 may be sized to correspond to the width of loop 4708 so that loop 4708 has a snug fit in channel 4932 in order to minimize movement of loop 4708 with respect to bar 4728, such as rotation about its longitudinal axis. Alternatively, bar can include a first and a second end and each end has a narrow portion or channel for receiving loops 4708. Such a channel may be sized to correspond to the width of loop 4708 so that loop 4708 has a snug fit in the channel in order to minimize movement of loop 4708 with respect to the bar, such as rotation about its longitudinal axis.

Figure 51:
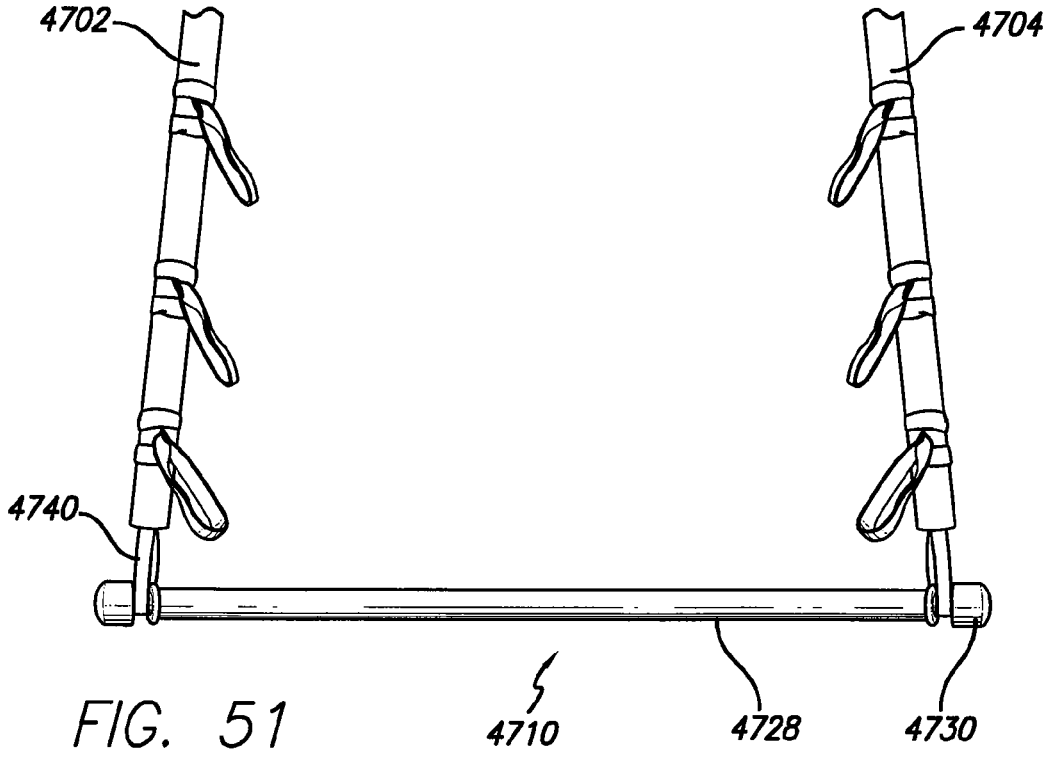
FIG. 51 is a partial view of FIG. 47 with an exemplary support positioned in a different location.
Figure 52:
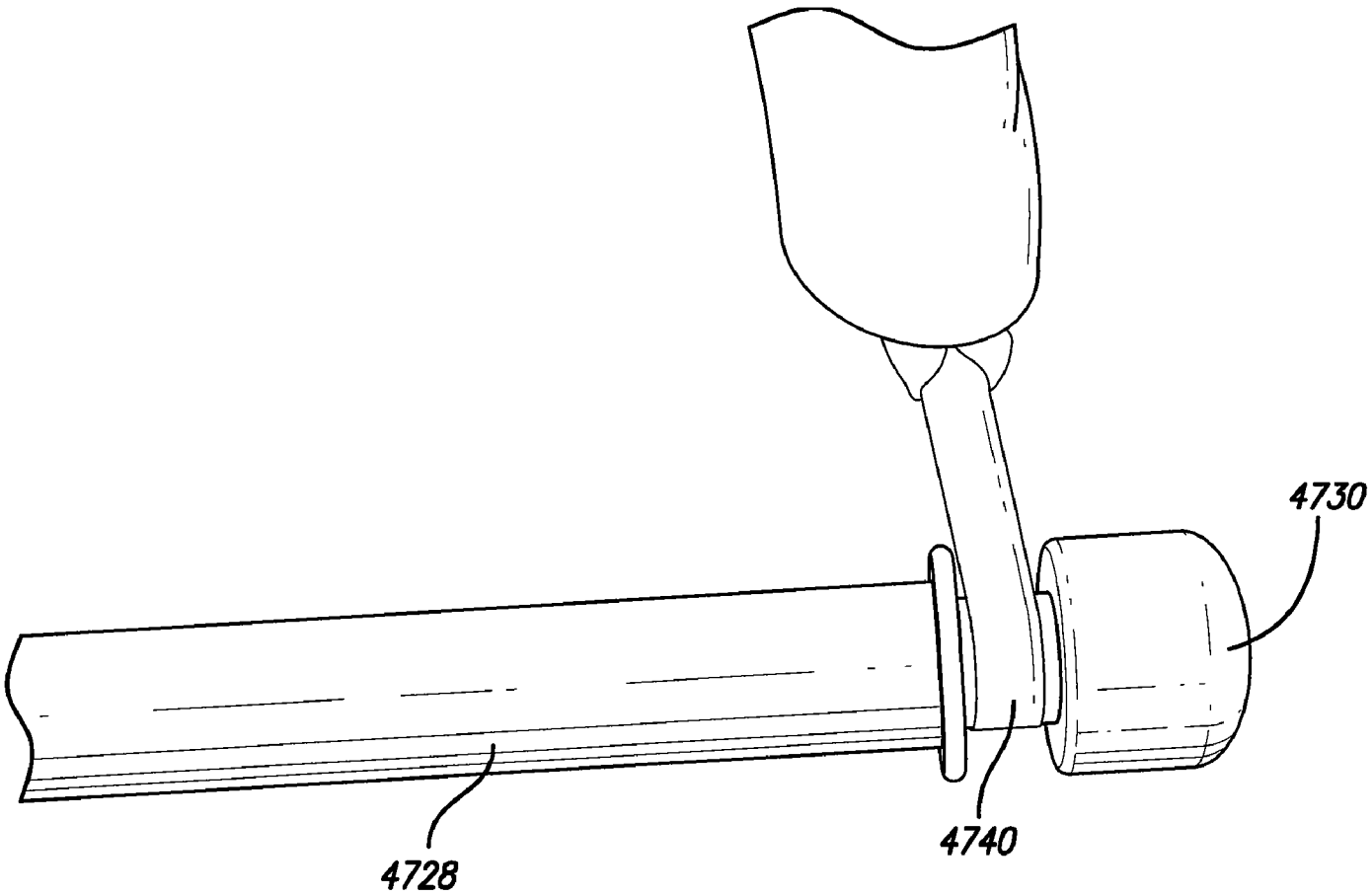
FIG. 52 is a close up view showing the connection of the exemplary support in FIG. 51.

Support 4710 may be removably attached to any of loops 4708 spaced along first and second elongated members depending upon the height of the user or the area of the body the user desires to exercise. In addition, as best seen in FIGS. 51-52, support 4710 may be attached to an end loop 4740 present at the end of first and second elongated members 4702, 4704. Channel 4932 receives end loop 4740 in a similar manner as when support 4710 is attached to a loop 4708.

Figure 53:
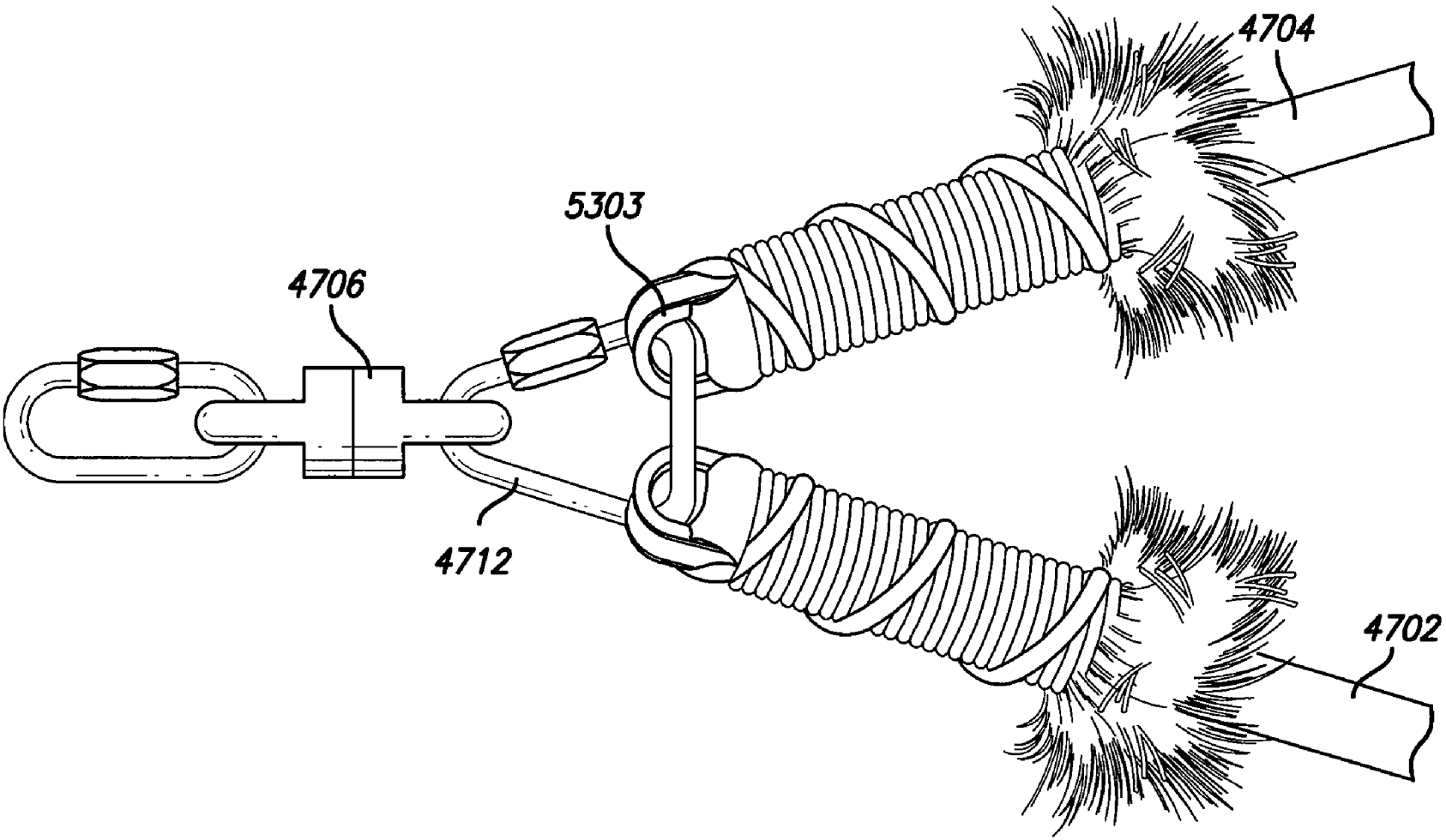
FIG. 53 is a close up view of an exemplary rotation mechanism for the exercise apparatus of FIG. 47.

As best seen in FIG. 53, the ends of elongated members 4702, 4704 attached to connector 4712 may be doubled over through a ring 5303 or other similar structure to provide a connection to connector 4712. The doubled over portion of elongated members 4702, 4704 may be surrounded with wrapping 4809 to hold the doubled over portion together. Rotation mechanism 4706 may be mounted through a carabiner 5307 or similar device to a ceiling, wall, or other structure such that exercise apparatus 4700 may rotate about a vertical axis or about an axis of the apparatus to permit exercises that involving twisting or turning. An exemplary rotation mechanism 4706 may be a swivel, such as a ball bearing swivel. Examples of suitable swivels include those available from the Petzl Company of Crolles, France.

In one embodiment, one or both elongated members can be marked at or near one or more attachments points to indicate suggested attachment of a support such as a bar or other accessory such as a foot or hand hold. For example, an elongated member can have markings to indicate the height of an attachment point or attached support or accessory from the floor or to indicate corresponding horizontal attachment points to assist a user in connecting a support, such as a bar, in a horizontal orientation.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. An exercise apparatus comprising:

a rotation mechanism;

a first elongated member connected to the rotation mechanism;

a second elongated member connected to the rotation mechanism;

at least two attachment loops extending from the first elongated member;

at least two attachment loops extending from the second elongated member; and a support including a first end and a second end, wherein the first end of the support is removably attached to one attachment loop on the first elongated member and the second end is removably attached to one attachment loop on the second elongated member.

2. The exercise apparatus of claim 1, wherein the support is attached to the first and second elongated members in a manner that the support is prevented from rotating about its longitudinal axis.

3. The exercise apparatus of claim 1, wherein each of the first and second elongated members comprises a core and a sheath surrounding the core.

4. The exercise apparatus of claim 3, wherein the sheath bears a load placed on the support.

5. The exercise apparatus of claim 3, wherein the core bears a load placed on the support.

6. The exercise apparatus of claim 1, wherein the support comprises:

a bar having first and second ends;

a first end cap attached to the first end of the bar; and a second end cap attached to the second end of the bar.

7. The exercise apparatus of claim 6, wherein the first and second end caps have a channel that receives the loop and a groove that holds the loop in place to prevent the bar from rotating about its longitudinal axis.

8. The exercise apparatus of claim 1, wherein the rotation mechanism is a swivel.

9. The exercise apparatus of claim 1, wherein the first and second elongated members are directly connected to the rotation mechanism.

10. The exercise apparatus of claim 1, wherein the first and second elongated members are connected to the rotation mechanism by a connector.

11. The exercise apparatus of claim 1, wherein the first elongated member and the second elongated member are a continuous member.

12. An exercise apparatus comprising:

a first elongated member comprising a plurality of attachment loops extending from the first elongated member;

a second elongated member comprising a plurality of attachment loops extending from the first elongated member; and a support comprising:

a bar having a first end and a second end;

wherein the first end comprises an anti-rotation feature and is attached to the at least one attachment point of the first elongated member in a manner that prevents the bar from rotating about its longitudinal axis, and wherein the second end comprises an anti-rotation feature and is attached to the at least one attachment point of the second elongated member in a manner that prevents the bar from rotating about its longitudinal axis.

13. The exercise apparatus of claim 12, wherein each of the first and second elongated members comprises a core and a sheath surrounding the core.

14. The exercise apparatus of claim 13, wherein the sheath bears a load placed on the bar.

15. The exercise apparatus of claim 13, wherein the core bears a load placed on the bar.

16. The exercise apparatus of claim 12, wherein the anti-rotation feature of the first and second ends of the bar comprises a channel that receives a portion of the loop and a groove that holds the loop to prevent the bar from rotating.

17. The exercise apparatus of claim 12, wherein the support is removably attached to the first and second elongated members.

18. An exercise apparatus comprising:

a rotation mechanism;

a first elongated member connected to the rotation mechanism;

a second elongated member connected to the rotation mechanism;

at least two attachment points disposed on the first elongated member;

at least two attachment points disposed on the second elongated member; and a support including a first end and a second end, wherein:

the first end of the support is removably attached to one attachment point on the first elongated member and the second end is removably attached to one attachment point on the second elongated member;

each of the first and second elongated members comprises a core and a sheath surrounding the core; and the attachment points comprise a loop having a first end, a second end, and a loop portion wherein the first and second ends of the loop are attached to an inner surface of the sheath and the loop portion extends outwardly from the sheath to form the loop.

19. An exercise apparatus comprising:

a first elongated member comprising at least one attachment point;

a second elongated member comprising at least one attachment point; and a support comprising a bar having a first end and a second end, wherein:

the first end comprises an anti-rotation feature and is attached to the at least one attachment point of the first elongated member in a manner that prevents the bar from rotating about its longitudinal axis;

the second end comprises an anti-rotation feature and is attached to the at least one attachment point of the second elongated member in a manner that prevents the bar from rotating about its longitudinal axis;

each of the first and second elongated members comprises a core and a sheath surrounding the core; and the at least one attachment point of the first and second elongated members comprises a loop having a first end, a second end, and a looping portion wherein the first and second ends of the loop are attached to an inner surface of the sheath and the looping portion extends outward from the sheath.

* * * * *